US006983115B2

(12) United States Patent
Isobe et al.

(10) Patent No.: US 6,983,115 B2
(45) Date of Patent: Jan. 3, 2006

(54) DEVELOPING CARTRIDGE AND PROCESS CARTRIDGE HAVING FIRST AND SECOND PROJECTED PORTIONS AND IMAGE FORMING APPARATUS MOUNTING SUCH A DEVELOPING CARTRIDGE

(75) Inventors: Hironobu Isobe, Numazu (JP); Yasufumi Yoshino, Numazu (JP); Koji Yamaguchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 23 days.

(21) Appl. No.: 10/668,494

(22) Filed: Sep. 24, 2003

(65) Prior Publication Data

US 2005/0191091 A1 Sep. 1, 2005

(30) Foreign Application Priority Data

Sep. 30, 2002 (JP) ..... 2002-286920

(51) Int. Cl.
*G03G 15/01* (2006.01)

(52) U.S. Cl. ..... 399/119; 399/227

(58) Field of Classification Search ..... 399/110, 399/119, 227, 226

See application file for complete search history.

(56) References Cited

U.S. PATENT DOCUMENTS

| | | | | |
|---|---|---|---|---|
| 5,331,373 | A | 7/1994 | Nomura et al. | |
| 5,331,390 | A * | 7/1994 | Kimura et al. | 399/227 |
| 5,452,056 | A | 9/1995 | Nomura et al. | |
| 5,585,889 | A | 12/1996 | Shishido et al. | |
| 5,950,049 | A * | 9/1999 | Yokomori et al. | 399/119 |
| 6,064,843 | A | 5/2000 | Isobe et al. | 399/111 |
| 6,324,370 | B1 | 11/2001 | Isobe et al. | 399/258 |
| 6,442,359 | B1 | 8/2002 | Numagami et al. | 399/111 |
| 6,463,233 | B2 | 10/2002 | Kojima et al. | 399/111 |
| 6,564,029 | B2 | 5/2003 | Kojima et al. | 399/258 |
| 6,782,219 | B2 * | 8/2004 | Yoshino et al. | 399/119 |
| 6,785,499 | B1 * | 8/2004 | Tanaka | 399/119 |
| 6,807,381 | B2 * | 10/2004 | Sawano | 399/227 |
| 6,834,173 | B2 * | 12/2004 | Yamaguchi et al. | 399/119 |
| 2002/0110386 | A1 | 8/2002 | Kanno et al. | 399/111 |
| 2003/0086723 | A1 | 5/2003 | Yamaguchi et al. | 399/119 |

(Continued)

FOREIGN PATENT DOCUMENTS

EP 0 794 470 9/1997

(Continued)

OTHER PUBLICATIONS

Patent Abstracts of Japan, vol. 016, No. 075, Feb. 24, 1992 (JP 3-264967).

(Continued)

*Primary Examiner*—Susan Lee
(74) *Attorney, Agent, or Firm*—Fitzpatrick, Cella, Harper & Scinto

(57) ABSTRACT

A developing cartridge is detachably mountable to a main assembly of an electrophotographic image forming apparatus. The apparatus includes: a frame; a developing device for developing an electrostatic latent image formed on an electrophotographic photosensitive member; a first projected portion engaging a first positioning portion provided in the main assembly of the apparatus when the cartridge is mounted to the main assembly to position the cartridge; a second projected portion engaging a second positioning portion provided in the main assembly when the cartridge is mounted to the main assembly to regulate rotation of the cartridge about the first positioning portion; and a cartridge guide member contacting a main assembly guide portion to guide the cartridge when the cartridge is mounted to the main assembly. The second projected portion is urged in a direction to contact the second positioning portion when the cartridge is set in the main assembly.

19 Claims, 23 Drawing Sheets

U.S. PATENT DOCUMENTS

2003/0091353 A1 5/2003 Hiroshima et al. ..... 399/25

FOREIGN PATENT DOCUMENTS

| | | |
|---|---|---|
| JP | 3-264967 | 11/1991 |
| JP | 7-121027 | 5/1995 |
| JP | 10-142940 | 5/1998 |
| JP | 10-221919 | 8/1998 |
| JP | 2908500 B2 | 4/1999 |
| JP | 2000-231239 | 8/2000 |

OTHER PUBLICATIONS

Patent Abstracts of Japan, vol. 1998, No. 10, Aug. 31, 1998 (JP 10-142940).

* cited by examiner

DEVELOPING CARTRIDGE AND PROCESS CARTRIDGE HAVING FIRST AND SECOND PROJECTED PORTIONS AND IMAGE FORMING APPARATUS MOUNTING SUCH A DEVELOPING CARTRIDGE

FIELD OF THE INVENTION AND RELATED ART

The present invention relates to a process cartridge, and a development cartridge, employed by an electrophotographic image forming apparatus such as an electrophotographic copying machine, an electrophotographic printer, etc. It also relates to an electrophotographic image forming apparatus which employs such a process cartridge and a development cartridge.

Here, an electrophotographic image forming apparatus is an apparatus which forms an image on recording medium with the use of an electrophotographic image formation process. It includes, for example, various types of electrophotographic copying machines, electrophotographic printers (LED printers, laser beam printer, etc.), electrophotographic facsimile machines, electrophotographic word processors, etc.

A process cartridge is a cartridge which integrally contains an electrophotographic photoconductive member as an image bearing member, and a minimum of a charging means, a developing means, a cleaning means, or an intermediary transferring means, and which is removably mountable in the main assembly of an electrophotographic image forming apparatus.

A development cartridge means a cartridge which integrally contains a developing means for developing an electrostatic latent image formed on an electrophotographic photoconductive member, and a toner storage portion for holding toner, and which is removably mountable in the main assembly of an electrophotographic image forming apparatus.

A process cartridge system, in which an electrophotographic photoconductive member; and a single or plurality of means among a charging means, a developing means, a cleaning means, etc., are integrally disposed in a cartridge removably mountable in the image assembly of an electrophotographic image forming apparatus, has been employed quite a while.

A process cartridge system substantially improves an electrophotographic image forming apparatus in operational efficiency and convenience, and also makes it possible for a user him- or herself to maintain an electrophotographic photoconductive member, as well as processing means such as a charging member, a developing means, a cleaning means, etc. In other words, a process cartridge system makes it easy to maintain an electrophotographic image forming apparatus. Therefore, a process cartridge system has come to be widely used in the field of an image forming apparatus.

In recent years, demands have increased for an electrophotographic color image forming apparatus capable of forming a color image. With this trend, it has been desired that the price of a color image forming apparatus substantially comes down, more specifically, it comes down low enough for an average user to afford a color image forming apparatus of his or her own.

In order to make such a desire attainable, not only must a color image forming apparatus be substantially reduced in price, but also it must be further improved in operability, in consideration of the fact that it is used by an average user.

In order to accomplish at the same time two objectives, that is, cost reduction and operability improvement, it is necessary to further reduce a color image forming apparatus in size, and also to make sure that the apparatus can more easily be supplied with consumables, and that a paper jam or the like can be more easily taken care of.

Thus, color image forming apparatuses equipped with a rotary type developing apparatus (rotational developing apparatus) having a rotary member in which a plurality of development cartridges are mountable (Japanese Laid-open Patent Applications 7-121027, 10-221919, and 2000-231239) have been proposed, and also, attempts have been made to commercialize the proposed apparatuses.

SUMMARY OF THE INVENTION

The primary object of the present invention is to provide a development cartridge and a process cartridge, which are higher in the accuracy with which they are positioned relative to the main assembly of an electrophotographic image forming apparatus when mounted in the main assembly, and an electrophotographic image forming apparatus in which such development cartridge and process cartridge are removably mountable.

Another object of the present invention is to provide a development cartridge and a process cartridge, which are easily and reliably mountable in the main assembly of an electrophotographic image forming apparatus, and an electrophotographic image forming apparatus in which such a development cartridge and a process cartridge are removably mountable.

Another object of the present invention is to provide a development cartridge, which is accurately and reliably positioned relative to the rotary member rotatably attached to the main assembly of an electrophotographic image forming apparatus, and is capable of taking, regardless of rotary rotation, a development position in which an electrostatic latent image formed on the electrophotographic photo conductive member can be developed by the developing means of one of the developments cartridges in the rotary member, and the home position into which it retreats to move the development cartridge away from the development position, and an electrophotographic image forming apparatus in which such a development cartridge is removably mountable.

Another object of the present invention is to provide a development cartridge, the driving force input gear of which reliably engages with the driving gear of the main assembly of an electrophotographic image forming apparatus, and an electrophotographic image forming apparatus in which such a development cartridge is removably mountable.

Another object of the present invention is to provide a development cartridge, which is capable of improving the degree of accuracy with which an electrophotographic photoconductive drum and a developing means are positioned relative to each other, and an electrophotographic image forming apparatus in which such a development cartridge is removably mountable.

Another object of the present invention is to provide a development cartridge, which is removably mountable in the main assembly of an electrophotographic image forming apparatus, and comprises: a frame; a developing means for developing an electrostatic latent image formed on an electrophotographic photoconductive member; a first projection, which projects from the frame, and engages with a first cartridge positioning portion of the main assembly to accurately position the development cartridge relative to the apparatus main assembly, when the development cartridge is mounted into the main assembly; a second projection, which projects from the frame, and engages with a second cartridge positioning portion of the main assembly to prevent the development cartridge from rotating about the first cartridge positioning portion, when the development cartridge is mounted into the main assembly; and a cartridge guiding member, which projects from the frame, guides the development cartridge by coming into contact with the cartridge guiding portion of the main assembly, when the development cartridge is mounted into the main assembly, and is pressed in the direction to be placed in contact with the second cartridge positioning portion, when the development cartridge is mounted into the main assembly, and an electrophotographic image forming apparatus in which such a development cartridge is removably mountable.

Another object of the present invention is to provide a process cartridge cartridge, which is removably mountable in the main assembly of an electrophotographic image forming apparatus, and comprises: a frame; an electrophotographic photoconductive member; a developing means for developing an electrostatic latent image formed on an electrophotographic photoconductive member; a first projection, which projects from the frame, and engages with a first cartridge positioning portion of the main assembly to accurately position the process cartridge relative to the apparatus main assembly, when the process cartridge is mounted into the main assembly; a second projection, which projects from the frame, and engages with a second cartridge positioning portion of the main assembly to prevent the process cartridge from rotating about the first cartridge positioning portion, when the process cartridge is mounted into the main assembly; and a cartridge guiding member, which projects from the frame, guides the process cartridge by coming into contact with the cartridge guiding portion of the main assembly, when the process cartridge is mounted into the main assembly, and is pressed in the direction to be placed in contact with the second cartridge positioning portion, when the process cartridge is mounted into the main assembly, and an electrophotographic image forming apparatus in which such a process cartridge is removably mountable.

Another object of the present invention is to provide an electrophotographic image forming apparatus, which is for forming an image on recording medium, and comprises: (i) a guiding portion; (ii) a first cartridge positioning portion; (iii) a second cartridge positioning portion; (iv) a cartridge mounting means for removably mounting a development cartridge, which is removably mountable in the main assembly of an electrophotographic image forming apparatus, and comprises: a frame; a developing means for developing an electrostatic latent image formed on an electrophotographic photoconductive member; a first projection, which projects from the frame, and engages with a first cartridge positioning portion of the main assembly to accurately position the development cartridge relative to the apparatus main assembly, when the development cartridge is mounted into the main assembly; a second projection, which projects from the frame, and engages with a second cartridge positioning portion of the main assembly to prevent the development cartridge from rotating about the first cartridge positioning portion, when the development cartridge is mounted into the main assembly; and a cartridge guiding member, which projects from the frame, guides the development cartridge by coming into contact with the cartridge guiding portion of the main assembly, when the development cartridge is mounted into the main assembly, and is pressed in the direction to be placed in contact with the second cartridge positioning portion, when the development cartridge is mounted into the main assembly; and (v) conveying means for conveying the recording medium.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in more detail with reference to the appended drawings. In the following descriptions, however, the measurements, materials, and shapes of the structural components in the embodiments, their positional relationships, etc., are not intended to limit the scope of the present invention, unless specifically noted.

Further, in the following descriptions of the preferred embodiments, the front side is the upstream side in terms of the direction in which a recording medium is conveyed from the transferring station to the fixing station (right side in FIG. 1), and the left or right side of the main assembly of an electrophotographic image forming apparatus is the left or right side as seen from the front side of the apparatus. Further, the lengthwise direction is the direction parallel to the axial direction of the development roller as a developing means.

{General Description of Image Forming Operation of Color Image Forming Apparatus}

First, referring to FIG. 1, the general structure of a color image forming apparatus will be described.

Figure 1:
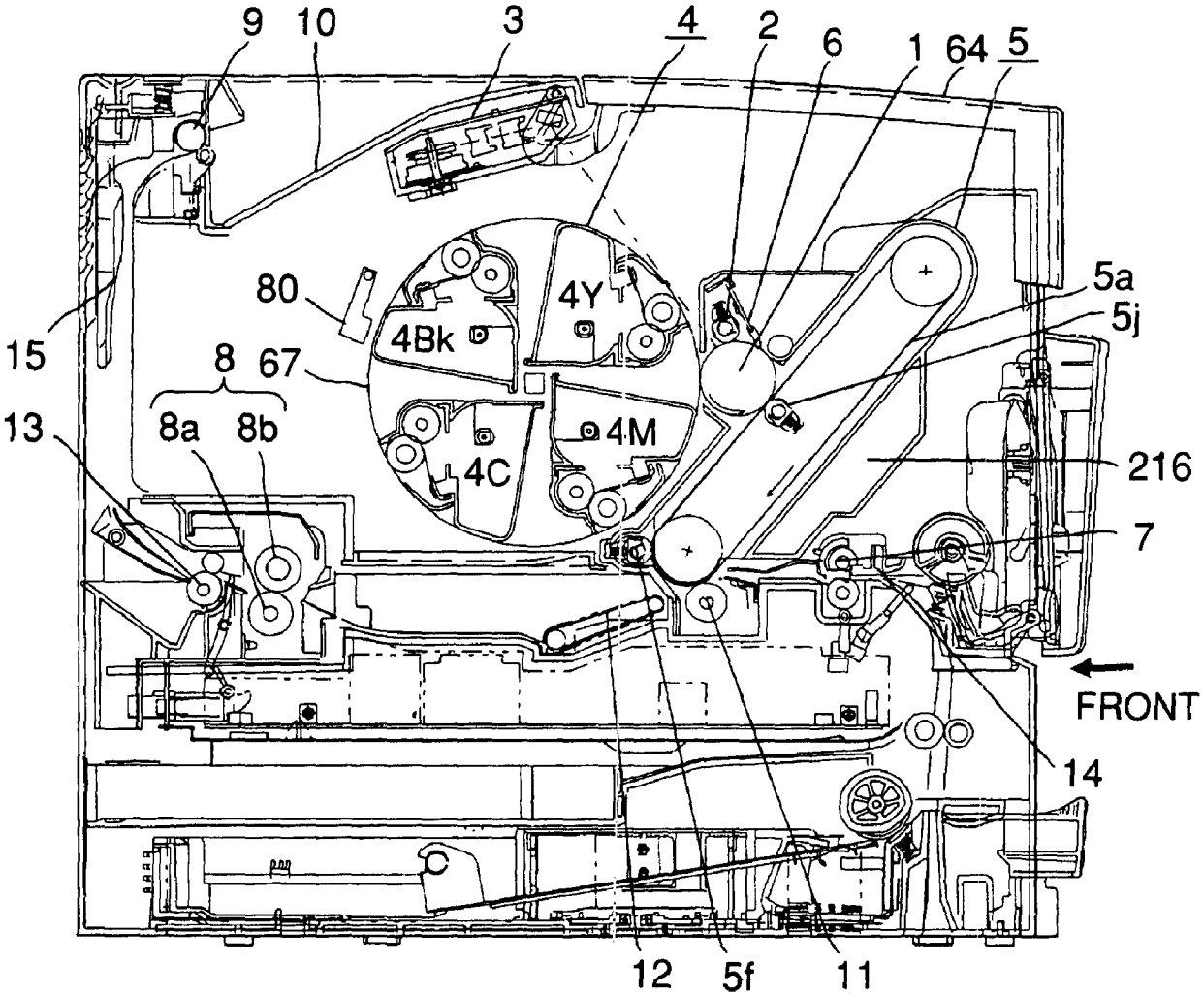
FIG. 1 is a vertical sectional view of the electrophotographic image forming apparatus in an embodiment of the present invention.

FIG. 1 is a vertical sectional view of a color laser beam printer, as an example of an electrophotographic color image forming apparatus in accordance with the present invention, the main assembly of which is holding development cartridges, a drum cartridge, and an intermediary transfer member unit. It shows the general structure of the apparatus.

In this color image forming apparatus in FIG. 1, an electrostatic latent image is formed on the electrophotographic photoconductive member (which hereinafter will be referred to as photoconductive drum 1), by projecting an optical image in accordance with image formation information, from an exposing means, and the electrostatic latent image is developed, with use of a developing means, into a developer image (which hereinafter may be referred to as a toner image. In synchronism with the formation of the toner image, a recording medium (which hereinafter will be referred to as transfer medium) is conveyed to the transfer station, and also, the toner image formed on the photoconductive drum 1 is transferred onto the intermediary transfer belt 5*a*.

Then, the toner image on the intermediary transfer belt 5*a* is transferred onto the transfer medium by the second transferring means 11. Then, the transfer medium is conveyed to the fixing device 8 having a pressure roller 8*a* and a heat roller 8*b*. In the fixing device 8, the toner image on the transfer medium is fixed. Then, the transfer medium is discharged into a delivery tray 10.

Next, the image forming steps will be described in more detail.

In synchronism with the rotation of the intermediary transfer belt 5*a*, the photoconductive drum 1 is rotated in the direction (counterclockwise direction) indicated by an arrow mark in FIG. 1. While the photoconductive drum 1 is rotated, the peripheral surface of the photoconductive drum 1 is uniformly charged by a charging apparatus 2. The uniformly charged portion of the peripheral surface of the photoconductive drum 1 is exposed by an exposing means 3; a beam of light modulated with the image formation information corresponding to the yellow component, for example, of an intended image, is projected onto the uniformly charged portion of the peripheral surface of the photoconductive drum 1. As a result, an electrostatic latent image corresponding to the yellow component is formed on the peripheral surface of the photoconductive drum 1.

More specifically, the uniformly charged portion of the peripheral surface of the photoconductive drum 1 is exposed by the exposing means in the following manner. The exposing means 3 projects a beam of light (optical image) modulated with the image formation information read in from an external apparatus or the like. The exposing means 3 comprises a laser diode, a polygon mirror, a scanner motor, a focusing lens, and a reflection mirror.

As image formation signals are given to the main assembly of an image forming apparatus from an external apparatus or the like, the laser diode emits light, as image formation light, in response to the image formation signals, and the light is projected onto the polygon mirror, which is being rotated at a high speed by a scanner motor. Thus, the light is reflected by the polygon mirror in a manner to be projected onto the peripheral surface of the photoconductive drum 1 by way of the focusing lens and a reflection mirror. As a result, the numerous points of the uniformly charged portion of the peripheral surface of the photoconductive drum 1 are selectively exposed. Consequently, an electrostatic latent image is formed on the uniformly charged portion of the peripheral surface of the photoconductive drum 1.

While the electrostatic latent image is formed, the developing device 4Y, that is, one of the development cartridges 4, is orbitally moved into the development position, and a predetermined bias voltage is applied to the development cartridge 4Y to develop the electrostatic latent image, that is, to adhere yellow toner to the electrostatic latent image.

Thereafter, a bias voltage, which is opposite in polarity to the toner, is applied to a primary transfer roller 5*j* disposed in a manner to oppose the photoconductive drum 1, with the interposition of the intermediary transfer belt 5*a* between the photoconductive drum 1 and transfer roller 5*j*. As a result, the yellow toner image on the photoconductive drum 1 is transferred (primary transfer) onto the intermediary transfer belt 5*a*.

As the primary transfer of the yellow toner image is completed as described above, the next developing devices is orbitally moved into the development position in which it is positioned in a manner to oppose the photoconductive drum 1. This process is also carried out for each of the cyan and black color components. As a result four toner images different in color are deposited in layers on the intermediary transfer belt 5*a*.

While the above described steps are carried out, the secondary transfer roller 11 is kept away from the intermediary transfer belt 5*a*, and so is the cleaning charge roller 51 functioning as a cleaning unit.

Then, after the deposition of the four toner images different in color on the intermediary transfer belt 5*a*, the secondary transfer roller 11 is pressed upon the intermediary transfer belt 5*a* as shown in FIG. 1. In addition, in synchronism with the pressing of the secondary transfer roller 11 on the intermediary transfer belt 5*a*, the transfer medium kept on standby at a predetermined location in the adjacencies of the pair of registration rollers 7 as a conveying means, is sent into the nip between the intermediary transfer belt 5*a* and secondary transfer roller 11.

On the immediately upstream side of the pair of registration rollers 7, a preregistration sensor 14 is disposed, which keeps a transfer medium on standby at a predetermined location, by cutting off the force for rotationally driving the pair of registration rollers 7 as it detects the leading end of the transfer medium.

The secondary transfer roller 11 is supplied with a bias voltage which is opposite in polarity to toner. Thus, the toner images on the intermediary transfer belt 5*a* are transferred (secondary transfer) all at once onto the surface of the transfer medium which has been sent to the aforementioned nip and is being conveyed through the nip.

The transfer medium, which is bearing the transferred toner images, is conveyed to the fixing device 8 by way of the conveyance belt unit 12. In the fixing device 8, the toner images are fixed to the transfer medium. Then, the transfer medium is further conveyed by the pair of discharge rollers 13 along the discharge guide 15, and then, is discharged into the delivery tray located at the top of the color image forming apparatus, by the pair of discharge rollers 9, concluding the image forming operation.

Meanwhile, after the completion of the secondary transfer, the cleaning charge roller 5*f* is pressed on the intermediary transfer belt 5*a*, and the residual charge on the surface of the intermediary transfer belt 5*a*, and the residual charge of the secondary residual toner, that is, the toner remaining on the intermediary transfer belt 5*a* after the secondary transfer, are removed by the application of a predetermined bias voltage.

The residual toner from which the residual charge has been removed is electrostatically transferred from the intermediary transfer belt 5*a* back onto the photoconductive drum 1 through the primary transfer nip; in other words, the surface of the intermediary transfer belt 5*a* is cleaned.

The secondary transfer residual toner having been transferred back onto the photoconductive drum 1 is removed by a cleaning blade 6 dedicated to the cleaning of the photoconductive drum 1, and is recovered.

The recovered residual toner, that is, waste toner, is conveyed through the waste toner conveyance path, which will be described later, to the waste toner box 216, and accumulated therein.

{Structure of Development Cartridge}

Figure 2:
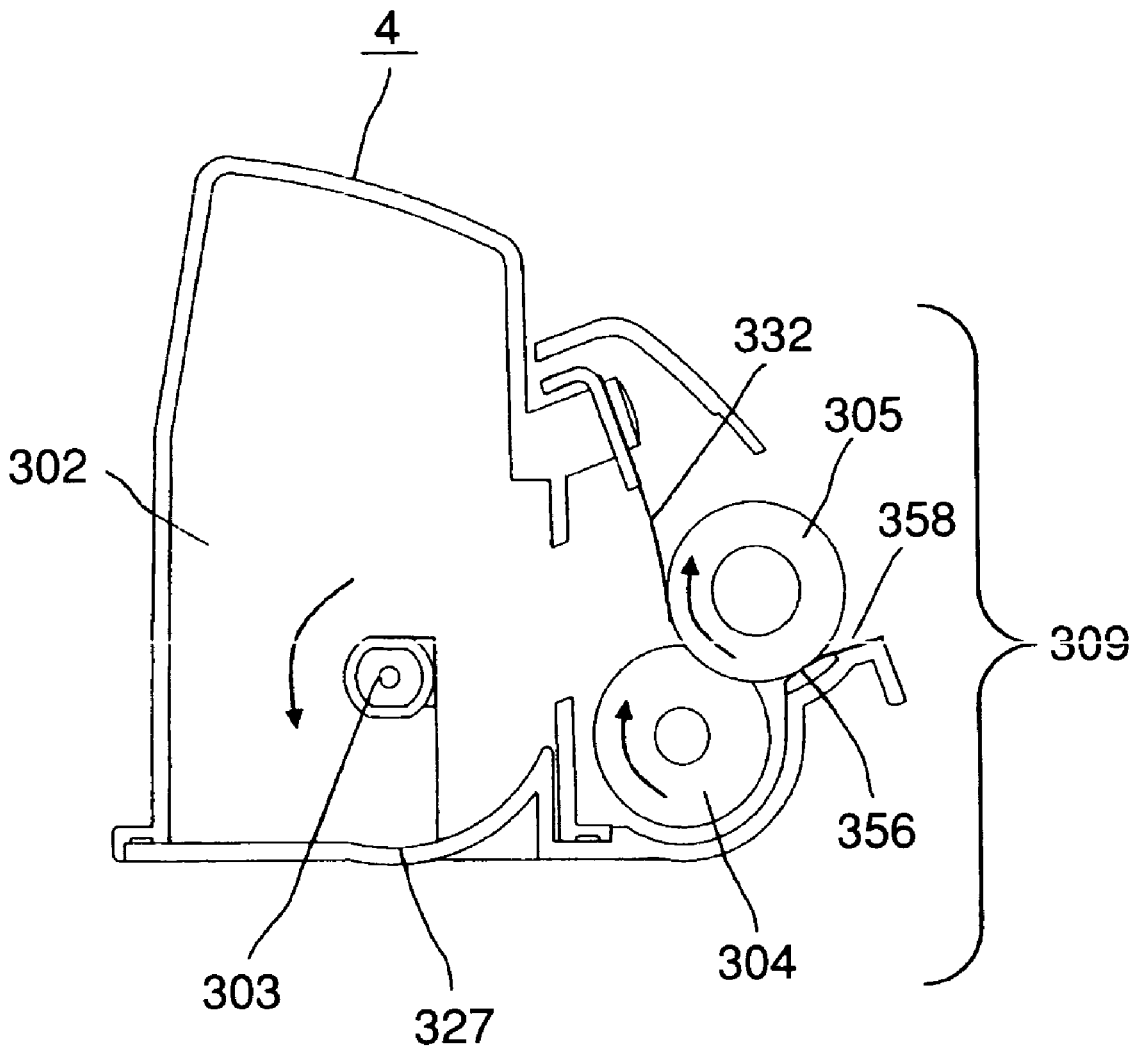
FIG. 2 is a sectional view of the development cartridge.

Referring to FIG. 2, the development cartridge 4 is roughly dividable into a toner storage portion 302 and a development portion 309.

The toner storage portion 302 is filled with toner. As a stirring means 303 in the toner storage portion 302 is rotated, the toner is conveyed to the development portion 309 by a predetermined amount.

After being conveyed to the development portion 309, the toner is coated onto the peripheral surface of the development roller 305 as a developing means, by the rotation of a spongy toner supplying roller 304. Then, as the development roller 305 is further rotated, the body of toner on the peripheral surface of the development roller 305 is formed into a thin layer while being given electrical charge by the friction between the toner, and the combination of a development blade 332 in the form of a piece of thin plate and the development roller 305. As the development roller 305 is further rotated, the thin layer of toner on the development roller 305 is conveyed to the development position, in which the electrostatic latent image on the photoconductive drum 1 is developed (visualized) into a toner image by the application of a predetermined development bias.

The residual toner on the peripheral surface of the development roller 305, that is, the toner which did not contribute to the visualization of the latent image on the photoconductive drum 1 and remained on the peripheral surface of the development roller 305, is stripped away by the toner supplying roller 304 while a fresh supply of toner is coated on the development roller 305 by the toner supply roller 304. In other words, the development operation is continually carried out.

Figure 9:
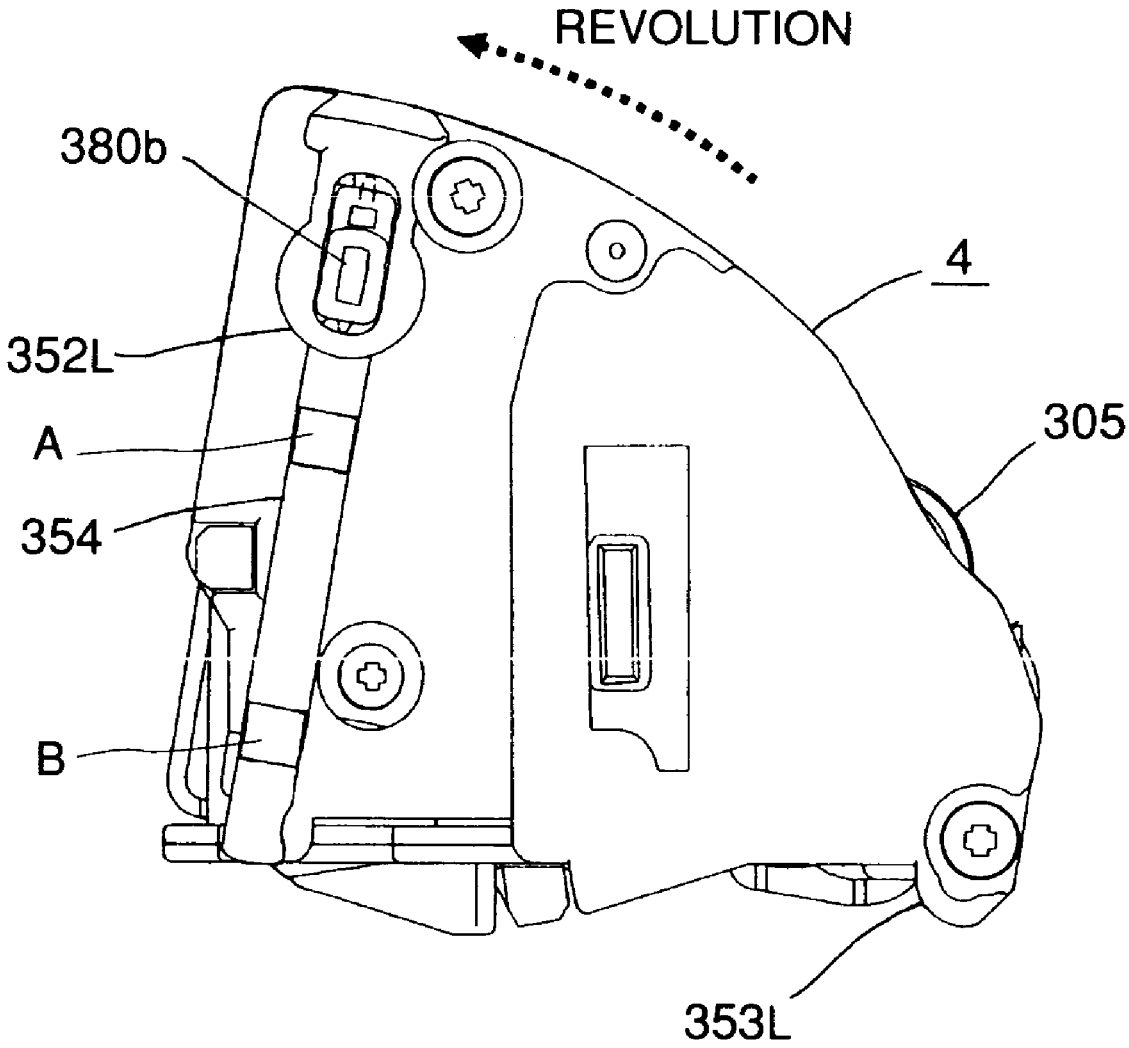
FIG. 9 is a plan view of the development cartridge, as seen from the side from which it is not driven.

Referring to FIG. 9, the development cartridge 4 is provided with a first projection 352L, (also called a positioning portion) and a guiding rib 354 as a cartridge guiding member, which are on the external surface of the end wall of the development cartridge 4, on the side from which the development cartridge 4 is not driven. The guiding rib 354 is located next to the first projection 352L. The two are integral parts of the end wall. The development cartridge 4 is also provided with electrical contact portions A and B, which are on the top surface of the guiding rib 354, being therefore aligned in the direction parallel to the guiding rib 354.

The electrical contact portion A is the input portion through the development bias is applied to the development roller 305 and toner supplying roller 304, whereas the electrical contact portion B is the input portion through which bias is applied to the development blade 332.

As described above, the electrical contact portions A and B are located near the positioning portion 352L of the development cartridge 4, minimizing thereby their positional deviation from the bias contact portions of the main assembly of the image forming apparatus, and therefore, assuring that they come into contact, and remain in contact, with their counterparts on the apparatus main assembly side. Further, since the electrical contact portions A and B in this embodiment are disposed on the top surface of the guiding rib 354 used when the development cartridge 4 is inserted, it is unnecessary for the electrical contact portions A and B to be protuberant from the cartridge wall, making it possible to minimize the cartridge size in terms of its lengthwise direction, which in turn makes it possible to reduce the size of the apparatus main assembly.

{Mounting and Dismounting of Cartridge}

Figure 22:
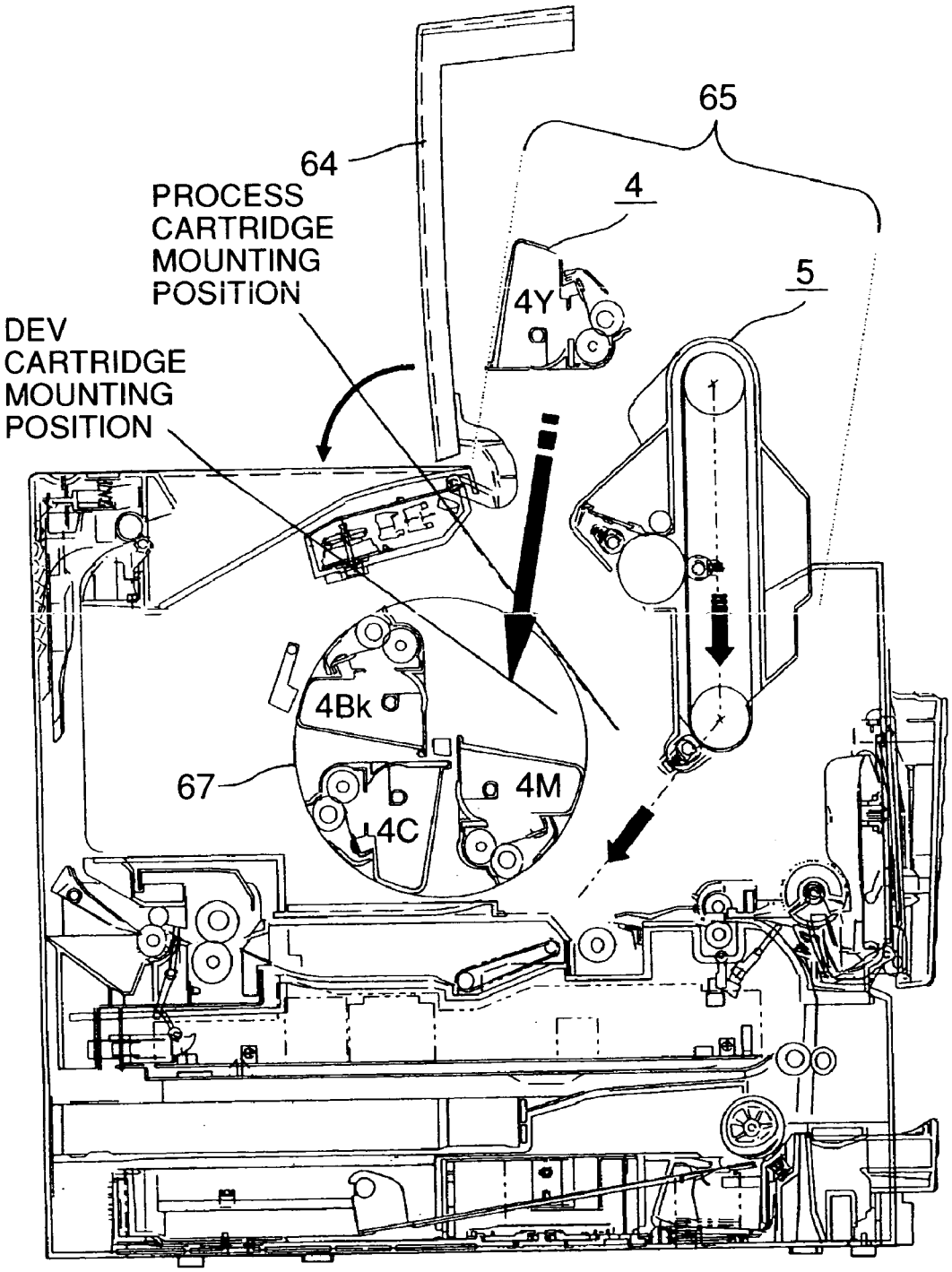
FIG. 22 is a vertical sectional view of an electrophotographic image forming apparatus, in accordance with the present invention, for showing how the development cartridge is mounted into, or dismounted from, the main assembly of the apparatus.

Referring to FIG. 22, as the top cover 64 of the apparatus main assembly is opened in the counterclockwise direction, an opening 65, through which cartridges are to be mounted into the apparatus main assembly, is exposed. All of the development cartridges 4 and the process cartridge 5 in this embodiment are made mountable or dismountable through this opening 65.

Further, the apparatus main assembly is structured so that paper jam or the like problems can be dealt with by removing the process cartridge through this opening 65.

In other words, such chores as supplying the image forming apparatus with consumables, dealing with paper jam or the like problems, etc., can be done by opening only a single door (top cover 64), improving thereby the image forming apparatus in operability.

{Mounting, Dismounting, and Positioning of Development Cartridge}

Next, the mounting, dismounting, and positioning of the development cartridge will be described.

The development cartridges 4 holding the yellow, magenta, cyan, and black toners, one for one, are solidly mounted into predetermined positions, one for one, in a rotary member 67 as a rotatable member. At this time, referring to FIGS. 3–14, and 22, the method for accurately positioning each development cartridge 4 relative to the rotary member 67 will be described in detail.

Figure 13:
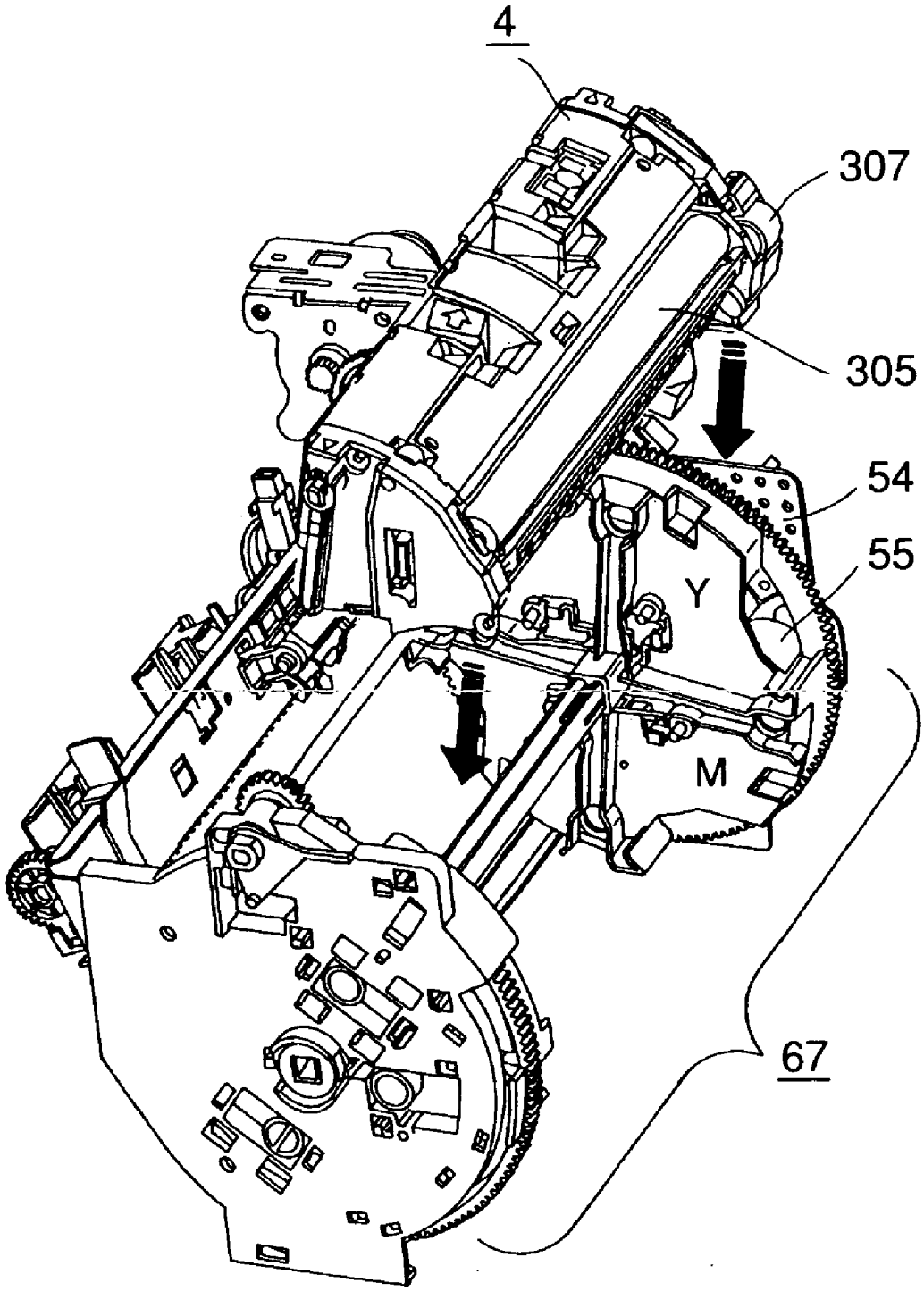
FIG. 13 is a perspective view of the rotary member, and a development cartridge which is being mounted into the rotary member, for showing the direction in which the development cartridge is mounted into the rotary member.

Referring to FIGS. 13 and 22, the development cartridge 4 is mounted into the main assembly of the image forming apparatus by being inserted straight into the apparatus main assembly in the direction indicated by an arrow mark, through the opening 65.

Figure 12:
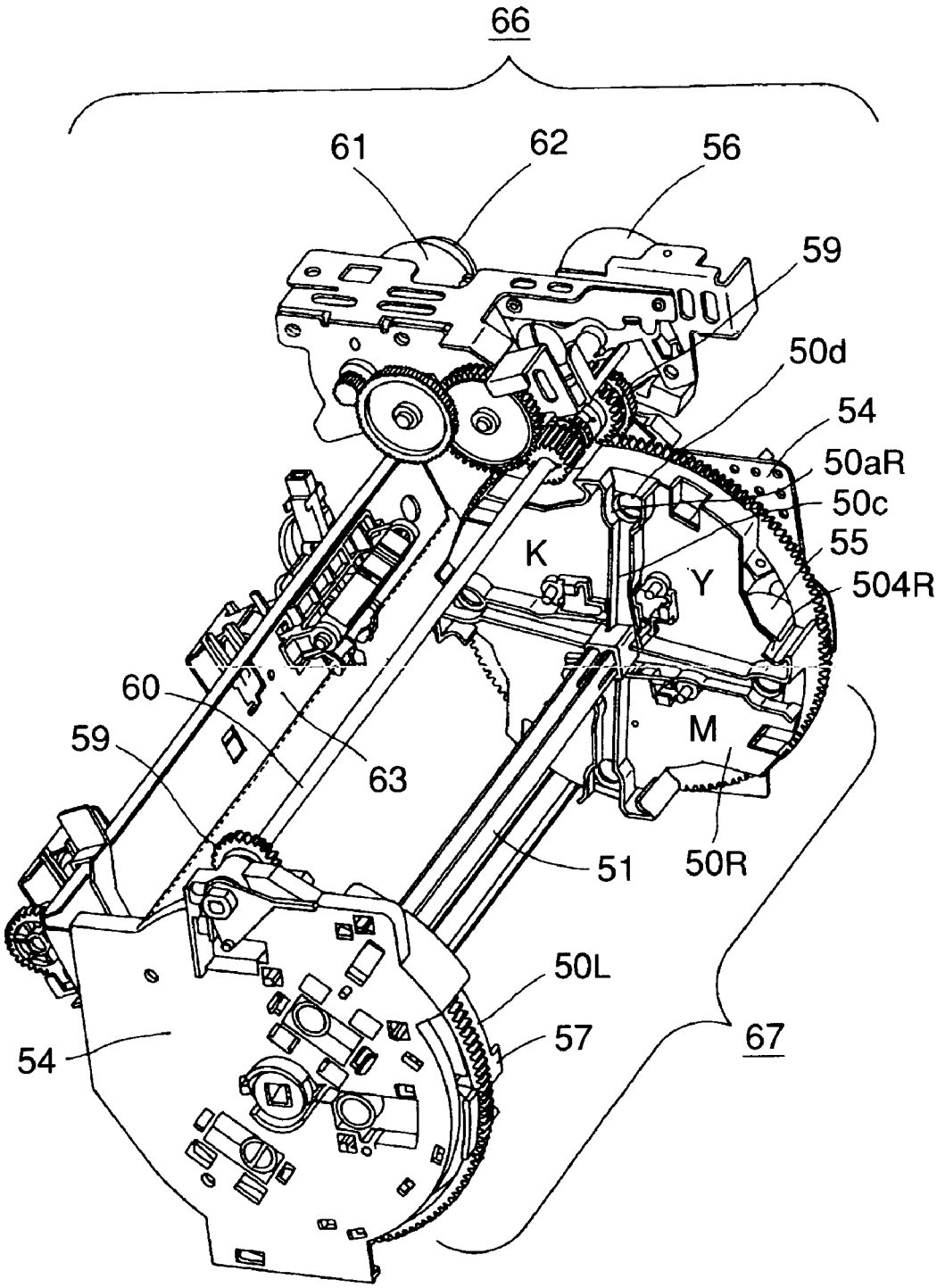
FIG. 12 is a perspective view of the rotary unit.

Referring to FIG. 12, within the apparatus main assembly, a rotary unit 66 is disposed, which is rotatable about the central axle 51 thereof. The rotary unit 66 is provided with a pair of flanges 50L and 50R in the form of a disc, which are solidly attached to the lengthwise ends of the central axle 51, one for one.

Figure 10:
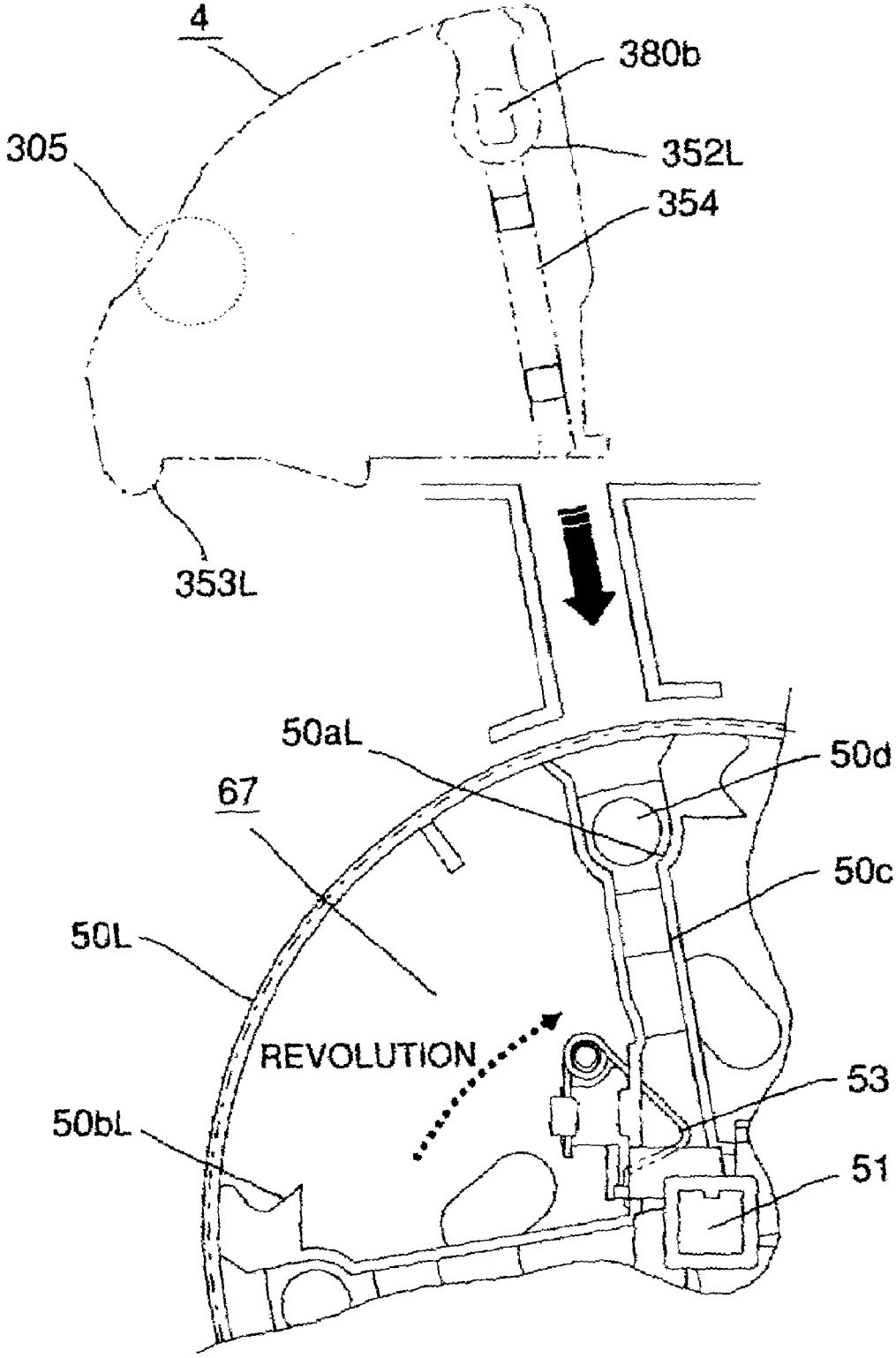
FIG. 10 is a plan view of the development cartridge and rotary member, as seen from the side from which the development cartridge is not driven, for showing the direction in which the development cartridge is inserted into the rotary.

The flange 50L is provided with: a cartridge guiding groove 50*c*, functioning as the cartridge guiding portion of the apparatus main assembly side, which guides a development cartridge when the cartridge is mounted or dismounted; a first cartridge positioning portion 50*a*L as a primary reference portion, relative to which the development cartridge 4 is positioned; and a secondary cartridge positioning portion 50*b*L as a portion for controlling the rotation of the development cartridge 4 (FIG. 10).

Figure 7:
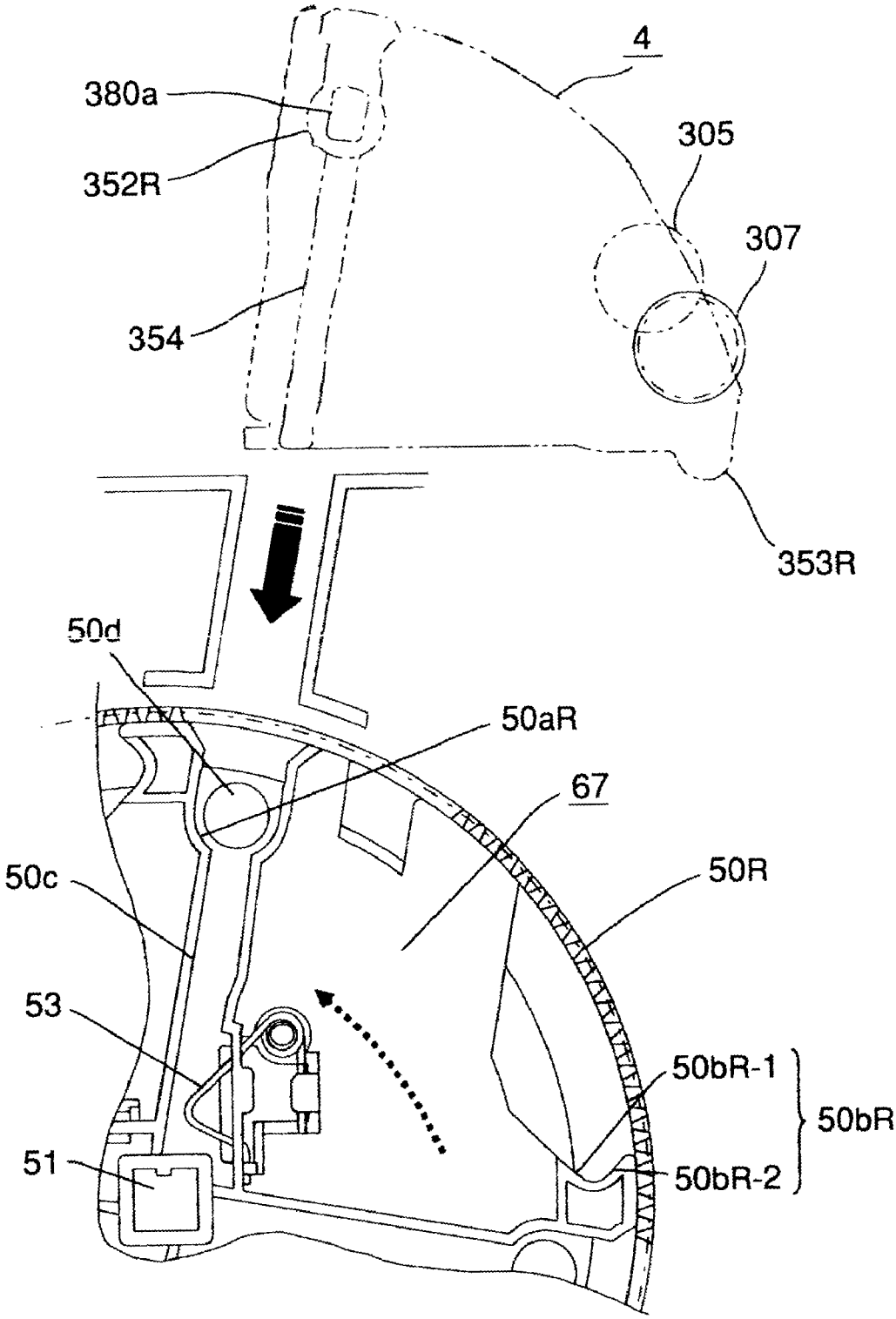
FIG. 7 is a plan view of the development cartridge and rotary member, as seen from the side from which the development cartridge is driven, for showing the direction in which the development cartridge is inserted into the rotary member.

Similarly, the flange 50R is provided with: a cartridge guiding groove 50*c*, which guides a development cartridge when the cartridge is mounted or dismounted; a fourth cartridge positioning portion 50*a*R, also as a primary reference portion, relative to which the development cartridge 4 is positioned; and a third cartridge positioning portion 50*b*R as a portion for controlling the rotation of the development cartridge 4 (FIG. 7).

The bottom walls of the first and fourth cartridge positioning portions 50*a*L and 50*a*R are provided with a hole 50*d* for retaining the development cartridge. This hole 50*d* plays the role of a hole into which a projection of the development cartridge 4 engages to prevent the development cartridge 4 from falling out of the rotary member 67.

In comparison, referring to FIG. 9, the lengthwise end wall of the development cartridge 4, on the side from which the development cartridge 4 is not driven (which hereinafter will be referred to as non driven side) is provided with: a guiding rib 354 which guides the development cartridge 4 when the development cartridge 4 is mounted or dismounted; a first projection 352L, as a primary reference portion, on the non-driven side, which is for accurately positioning the development cartridge 4 relative to the rotary member 67, and is arcuate in cross section; and a second projection 353L, which is for controlling the rotation of the development cartridge 4, and is also arcuate in cross section.

Figure 6:
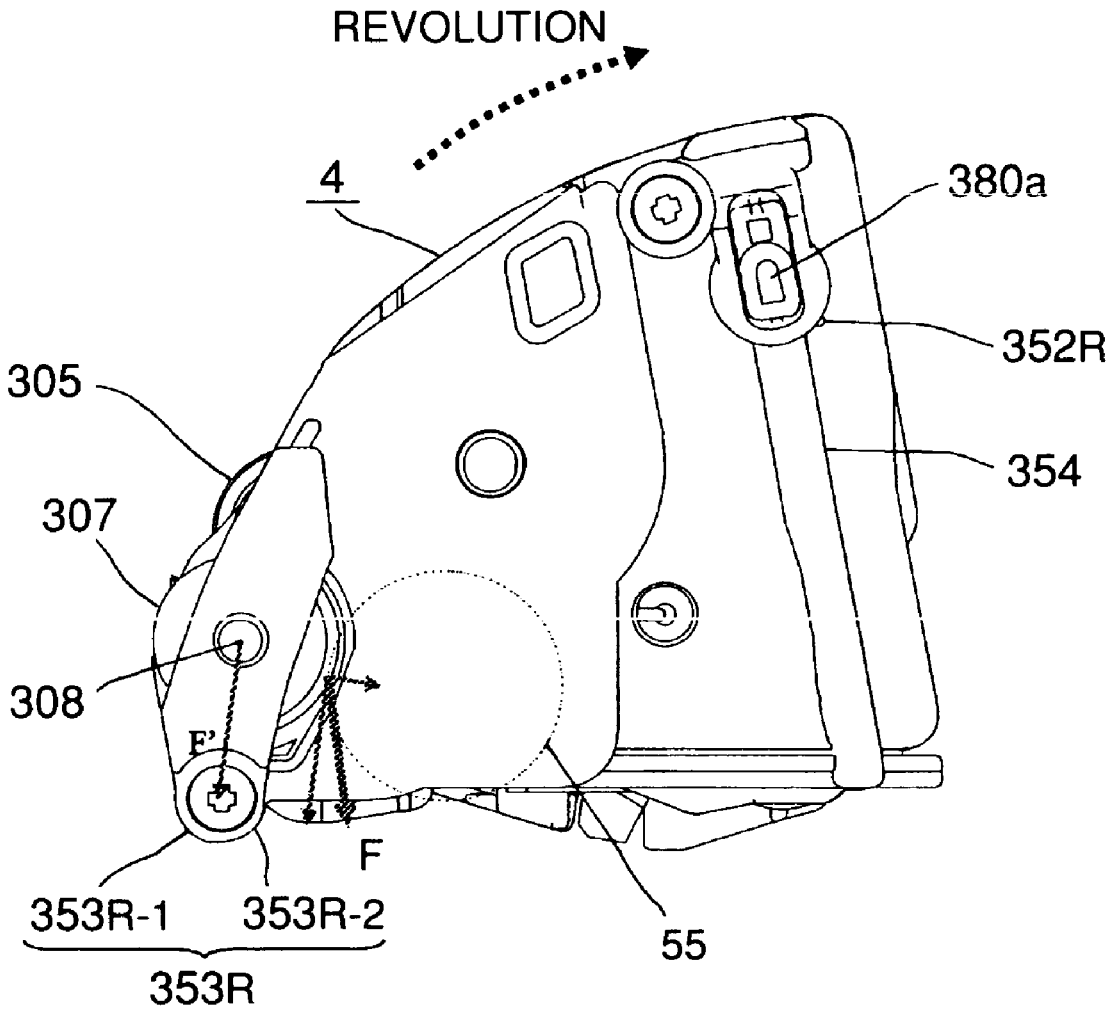
FIG. 6 is a plan view of the development cartridge, as seen from the side from which it is driven.

Next, referring to FIG. 6, the lengthwise end wall of the development cartridge 4, on the side from which the development cartridge 4 is driven (which hereinafter will be referred to as driven side), is provided with: a guiding rib 354 which guides the development cartridge 4 when the development cartridge 4 is mounted or dismounted; a fourth projection 352R, as a primary reference portion, on the driven side, which is for accurately positioning the development cartridge 4 relative to the rotary member 67, and is arcuate in cross section; and a third projection 353R, which is for controlling (retaining) the lengthwise end of the development cartridge 4, on the driven side, and is also arcuate in cross section.

The first and fourth projections 352L and 352R are aligned in the lengthwise direction of the development cartridge 4, and so are the second and third projections 353L and 353R. In other words, they are aligned in the direction parallel to the generator (or axial line) of the development roller 305.

Referring to FIGS. 7 and 10, the rotary member 67 is provided with a pair of springs 53, functioning as pressure applying members, which are for keeping the development cartridge 4 pressured in the direction to rotate in the counterclockwise direction of the drawing, and are attached to the flanges 50L and 50R, one for one, so that the functional parts of the springs 53 protrude into the corresponding cartridge guiding grooves 50*c*. In other words, each pressure applying member 53 keeps the cartridge pressured in the direction opposite to the direction in which the rotary member 67 is rotated.

Figure 8:
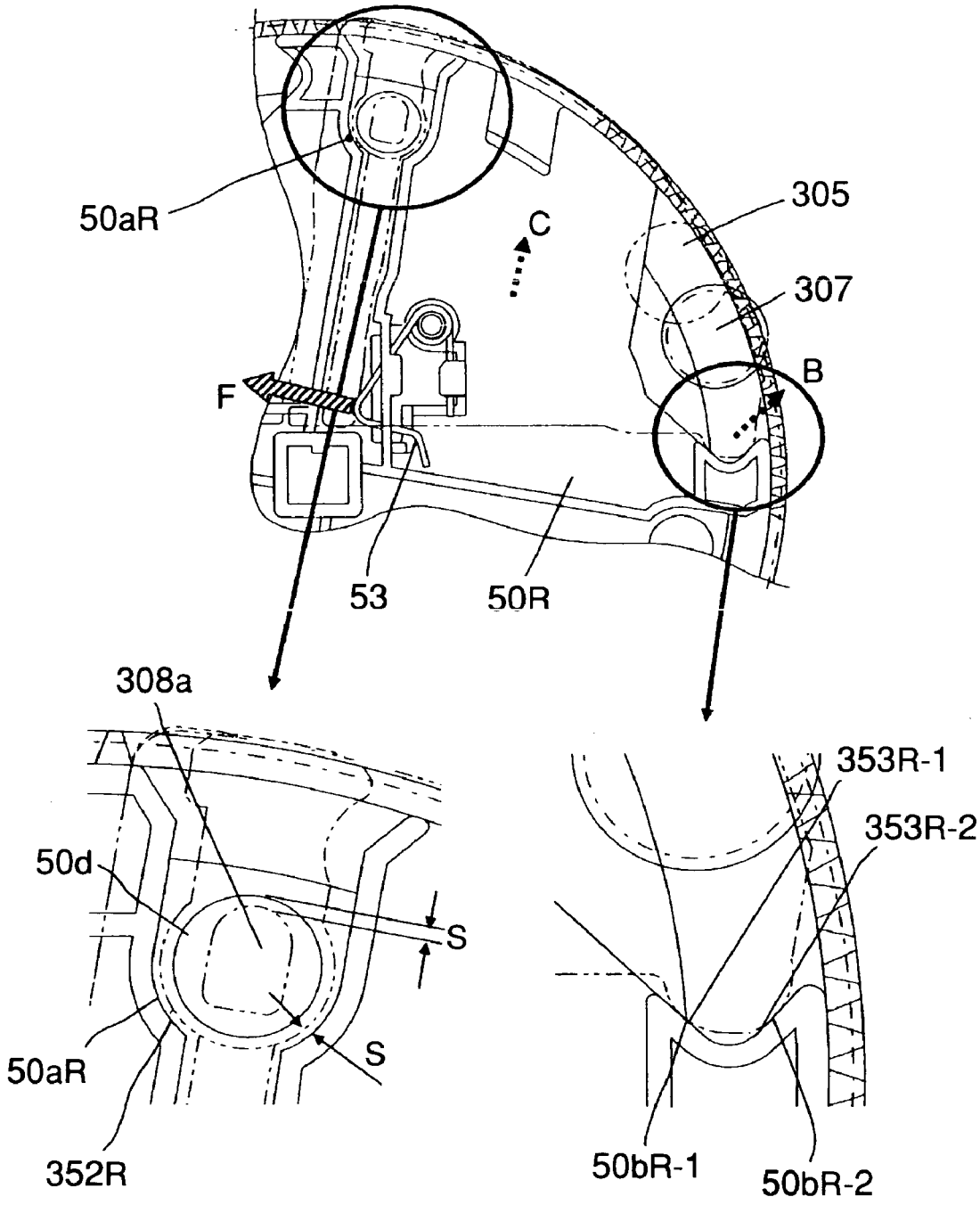
FIG. 8 is a plan view of the development cartridge and rotary member, as seen from the side from which the development cartridge is driven, for showing the development cartridge in the rotary.
Figure 11:
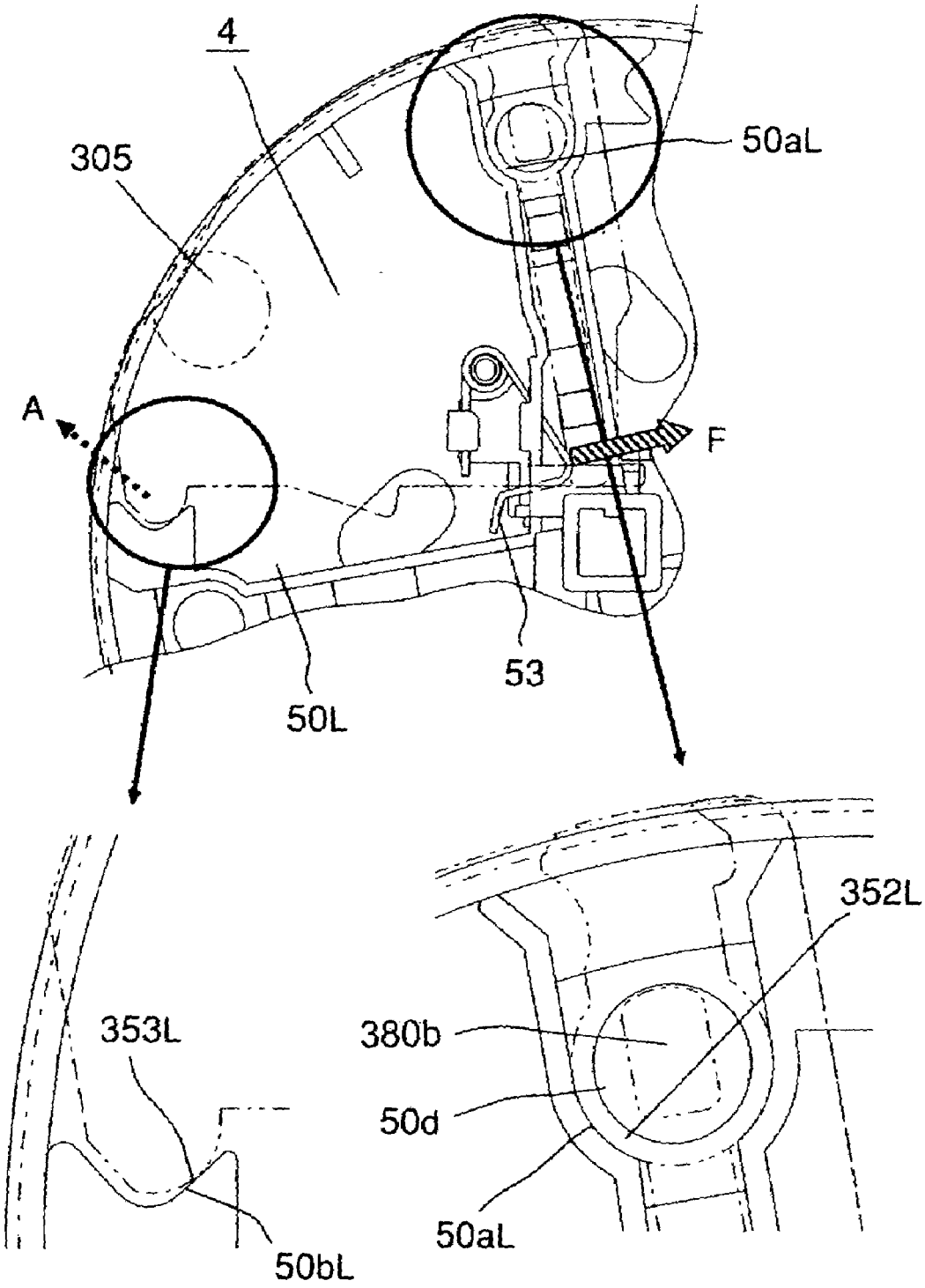
FIG. 11 is a plan view of the development cartridge and rotary member, as seen from the side from which the development cartridge is not driven, for showing the development cartridge in the rotary member.

Referring to FIGS. 8 and 11, the pressure N from the pressure applying springs 53 generates such a moment M, in the development cartridge 4, that causes the development cartridge 4 to pivot about the first and fourth projections 352L and 352R, causing thereby the second and third projections 353L and 353R of the development cartridge 4 to be placed, and kept, in contact with the second and third cartridge positioning portions 50*b*L and 50*b*R of the flanges 50L and 50R, respectively.

As the rotary member 67 is rotated, the development cartridge 4 is subjected to centrifugal force which acts in the direction to eject the development cartridge 4 outward of the rotary member 67. However, the retractable projections 380*a* and 380*b*, which will be described later, settle in the corresponding holes 50*d*. Therefore, the development cartridge 4 is pressured by the centrifugal force in the direction to pivot about the first and fourth projections 352L and 352R, in other words, in the direction to move the portions of the development cartridge 4 having the second and third projections 353L and 353R outward of the rotary member 67 in terms of the radius direction of the rotary member 67.

In this embodiment, however, the pair of pressuring springs 53 are formed so that the amount of the pressure produced by the pair of pressuring springs 53 exceeds the amount of the above-described centrifugal force. Therefore, even though the development cartridge 4 is repeatedly orbitally rotated and stopped, the development cartridge 4 is prevented from floating or being dislodged from the second and third cartridge positioning portions 50*b*L and 50*b*R.

With the provision of the above-described structural arrangement, the position of the development cartridge 4 relative to the rotary member 67 remains accurately fixed. Therefore, the development roller 305 of the development cartridge 4 is kept in contact with the photoconductive drum 1 of the process cartridge 5, while being kept parallel to the axial line of the photoconductive drum 1. In addition, it is possible to reduce the difference between the amount of the pressure to which the left side of the development cartridge 4 is subjected and the amount of the pressure to which the right side of the development cartridge 4 is subjected. Therefore, it is possible to reduce the difference in density, between the left and right sides of an image, resulting from the unbalance between the left and right side of the development cartridge 4 in terms of the pressure to which they are subjected.

Next, referring to FIG. 11, the rotary member 67 and the development cartridge 4 are designed so that the second projection 353L on the external surface of the lengthwise end wall of the development cartridge 4, on the non-driven side, comes into contact with only one area of the cartridge contacting surface of the second cartridge positioning portion 50*b*L of the flange 50L. In terms of the radius direction of the rotary member 67, this area of contact between the second projection 353L and second cartridge positioning portion 50*b*L is on the center side of the rotary member 67 with respect to the center of the cartridge contact surface of the second cartridge positioning portion 50*b*L.

Figure 16:
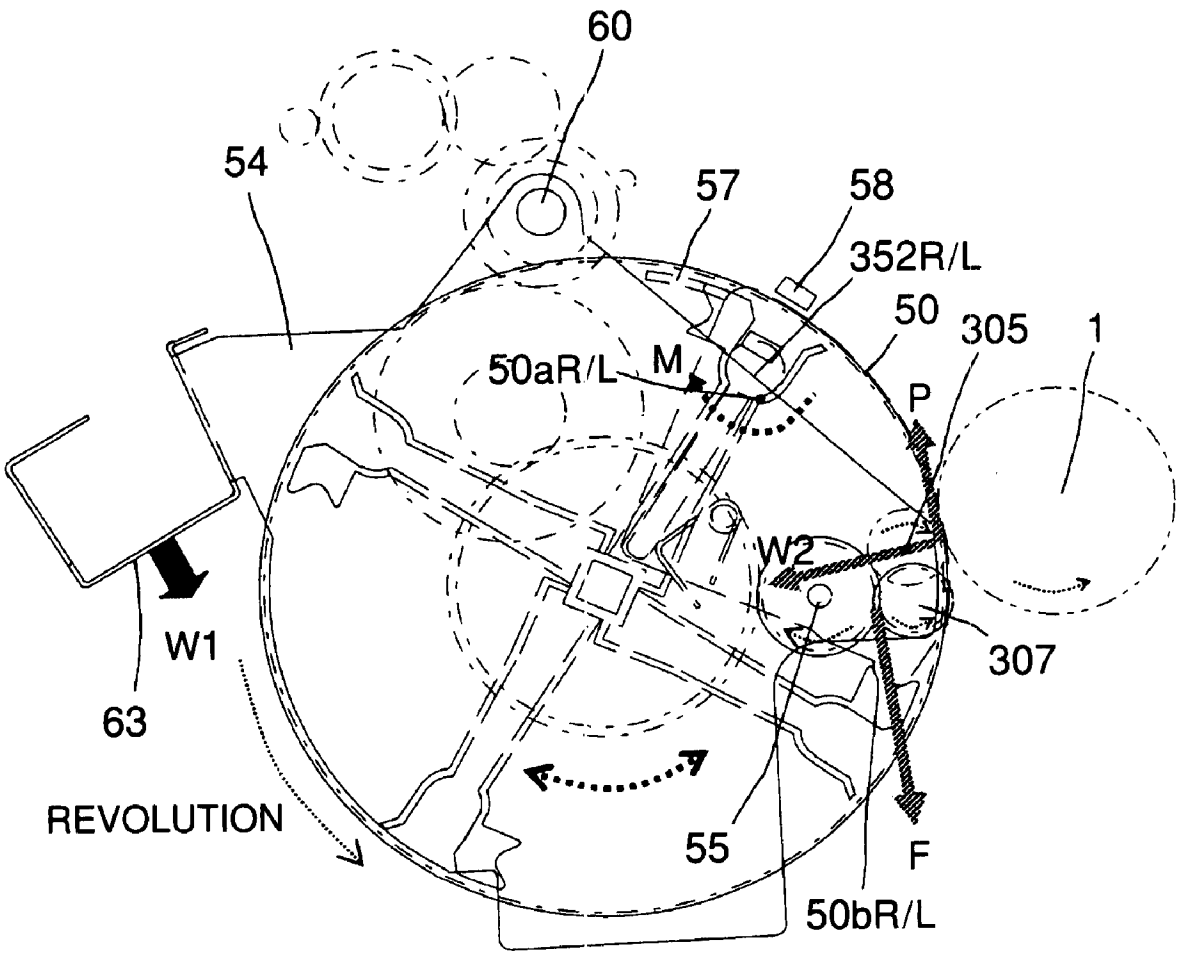
FIG. 16 is a phantom side view of the development cartridge and rotary unit, for showing how the development cartridge is placed in contact with the photoconductive drum and is driven.

Referring to FIG. 8, the third projection 353R of the driven side of the development cartridge 4 comes into contact with two areas of the cartridge contacting surface of the third cartridge positioning portion 50*b*R of the flange 50R. In terms of the radius direction of the rotary member 67, one of the two contact areas between the third projection 353R and the third cartridge positioning portion 50*b*R is on the center side of the rotary member 67 with respect to the center of the cartridge contact surface of the third cartridge positioning portion 50*b*R, and the other is on the outward side of the rotary member 67. More specifically, the contact areas 353R-1 and 353R-2 of the cartridge positioning projection 353R of the development cartridge 4 come into contact with the contact areas 50*b*R-1 and 50*b*R-2, respectively, of the third cartridge positioning portion 50*b*R of the flange 50R. This structural arrangement is made because, as the development cartridge 4 receives a driving force, through its gear 307, from the apparatus main assembly, it is subjected to a force F which acts in the direction indicated by an arrow mark, as shown in FIG. 16. In other words, the above-described structural arrangement is made to assure that the development cartridge 4 is accurately positioned relative to the rotary member 67 and remains therein.

The first and fourth projections 352L and 352R of the development cartridge 4 are the portions by which the development cartridge 4 is pivotally supported by the cartridge positioning portions of the rotary member 67. The first projection 352L of the development cartridge 4 is made to exactly engage with the first cartridge positioning portion 50*a*L of the flange 50L, whereas the fourth projection 352R of the development cartridge 4 is made to engage with the fourth cartridge positioning portion 50*a*R of the flange 50R, with the presence of a certain amount of a gap.

Figure 3:
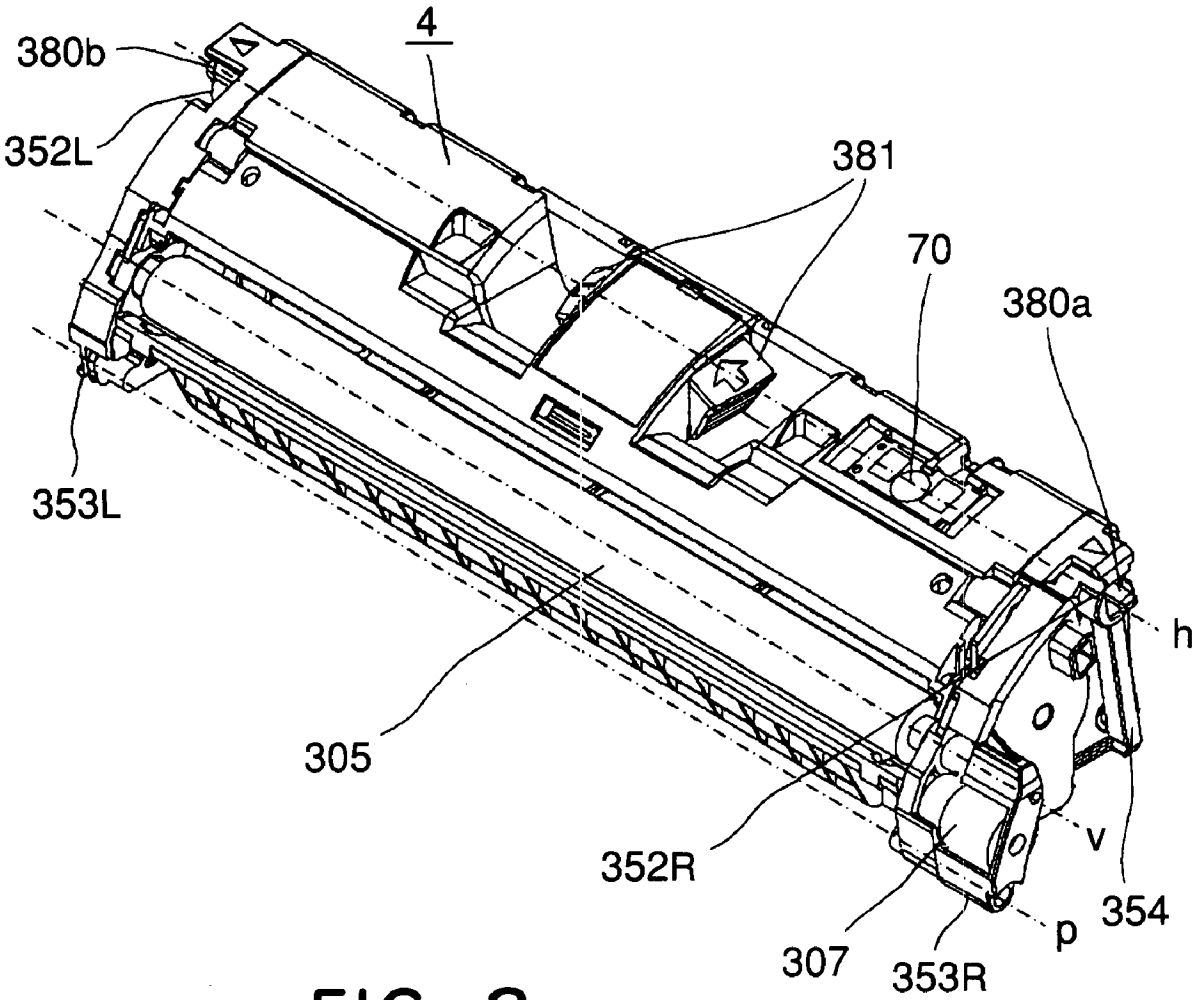
FIG. 3 is a perspective view of the development cartridge, as seen from the side from which the development cartridge is driven.
Figure 4:
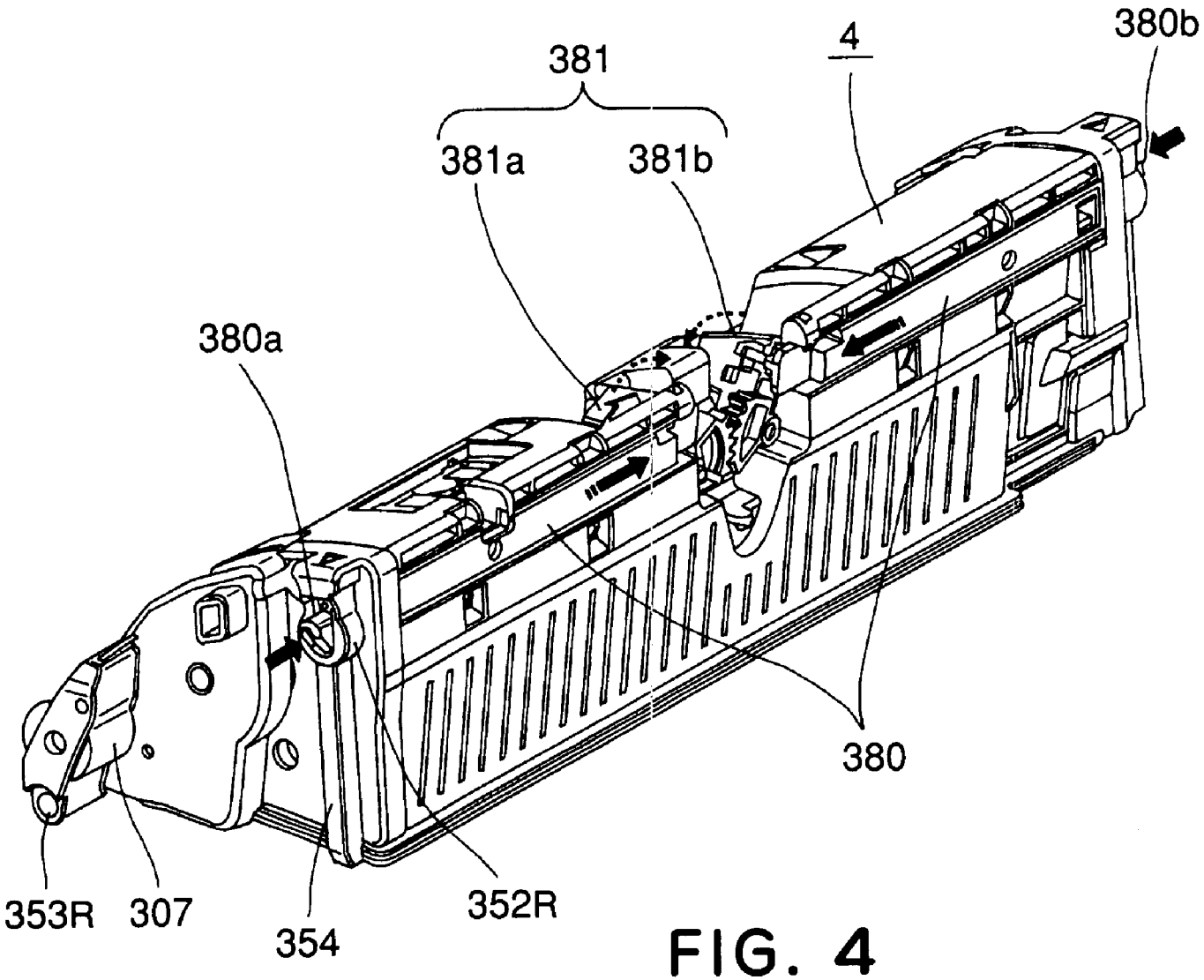
FIG. 4 is a perspective view of the development cartridge, for showing the movement of the slidable members of the development cartridge.
Figure 5:
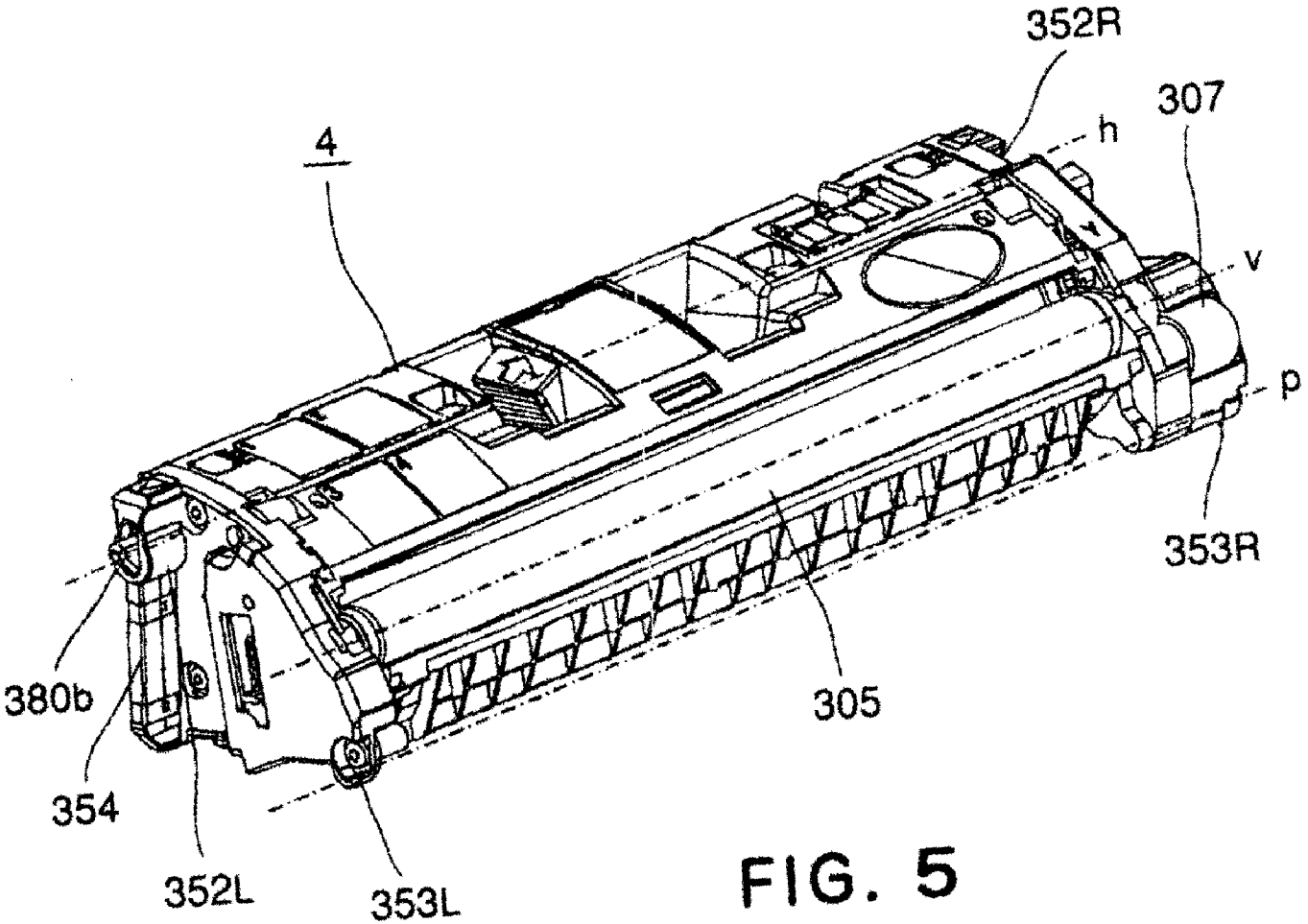
FIG. 5 is a perspective view of the development cartridge, as seen from the side from which the development cartridge is not driven.

Next, referring to FIGS. 3, 4, and 5, the development cartridge 4 is provided with a pair of retractable projections 380*b* and 380*a*, which are extendable from, or retractable into, the first and fourth projections 352L and 352R, respectively.

These retractable projection 380*b* and 380*a* are integral parts of the left and right lengthwise ends, respectively, of a pair of slidable members 380, in the form of a rods, the length of which is roughly half the length of the development cartridge 4. Thus, the retractable projections 380*b* and 380*a* can be made to project from, or retracted into, the ends of the first and fourth projections 352L and 352R, respectively, by slidably moving the slidable members 380.

Further, the development cartridge 4 is provided with a hinge-like handle 381, which is attached the roughly center portion, in terms of the lengthwise direction, of the top portion of the development cartridge 4. The hinge-like handle 381 is kept pressured in the opening direction by an unshown torsion coil spring.

More specifically, the hinge-like handle 381 comprises the left and right members 381*a* and 381*b*, which are connected to the pair of slidable members 380, one for one. Thus, the slidable members 380 are slidably movable by rotationally moving the left and right members 381*a* and 381*b* of the hinge-like handle 381.

Normally, the left and right members of the hinge-like handle 381 are kept apart by being pressured by the torsion coil spring, keeping thereby the retractable projection 380*a*, that is, the end portion of the slidable member 380, projecting from the end of the fourth projection 352R. However, as the hinge-like handle 381 is grasped, the left and right members thereof are rotationally moved, causing the retractable projection 380*a*, that is, the end portion of the slidable member 380 to retract into the fourth projection 352R.

Further, the left and right rotational members 381*a* and 381*b* of the hinge-like handle 381 are provided with a toothed portion, which is on the side opposite to the side on which the fingers are placed to rotationally move the left and right members 381*a* and 381*b*. The toothed portions of the left and right rotational members 381*a* and 381*b* are meshed with each other. Therefore, as one of the two rotational members 381*a* and 381*b* is rotationally moved, the other rotational member is rotationally moved by the rotational movement of the first rotational member. Thus, even if only one of the two rotational members 381*a* and 381*b* of the hinge-like handle 381 is rotationally moved, both of the slidable members 380 are reciprocally moved at the same time.

When inserting the development cartridge 4 into the rotary member 67, first, the development cartridge 4 is to be grasped by the hinge-like handle 381, and then, the development cartridge 4 is to be inserted, with the pair of guiding ribs 354 of the development cartridge 4, which are on the external surfaces of the lengthwise end walls of the development cartridge 4, fitted in the cartridge guiding groove 50*c* of the flange 50L and the cartridge guiding groove 50*c* of the flange 50R, one for one.

Then, the hinge-like handle 381 is to be released from the fingers as the first and fourth projections 352L and 352R of the development cartridge 4, which are arcuate in cross section, come into contact with the first and fourth cartridge positioning portions 50*a*L and 50*a*R of the flange 50L and 50R, respectively.

Upon the release of the hinge-like handle 381, the retractable projections 380*a* and 380*b* project from the first and fourth projections 352L and 352R, respectively, and enter the aforementioned hole 50*d* of the bottom wall of the first cartridge positioning portion 50*a*L, and the hole 50*d* of the bottom wall of the fourth cartridge positioning portion 50*a*R, respectively.

Figure 14:
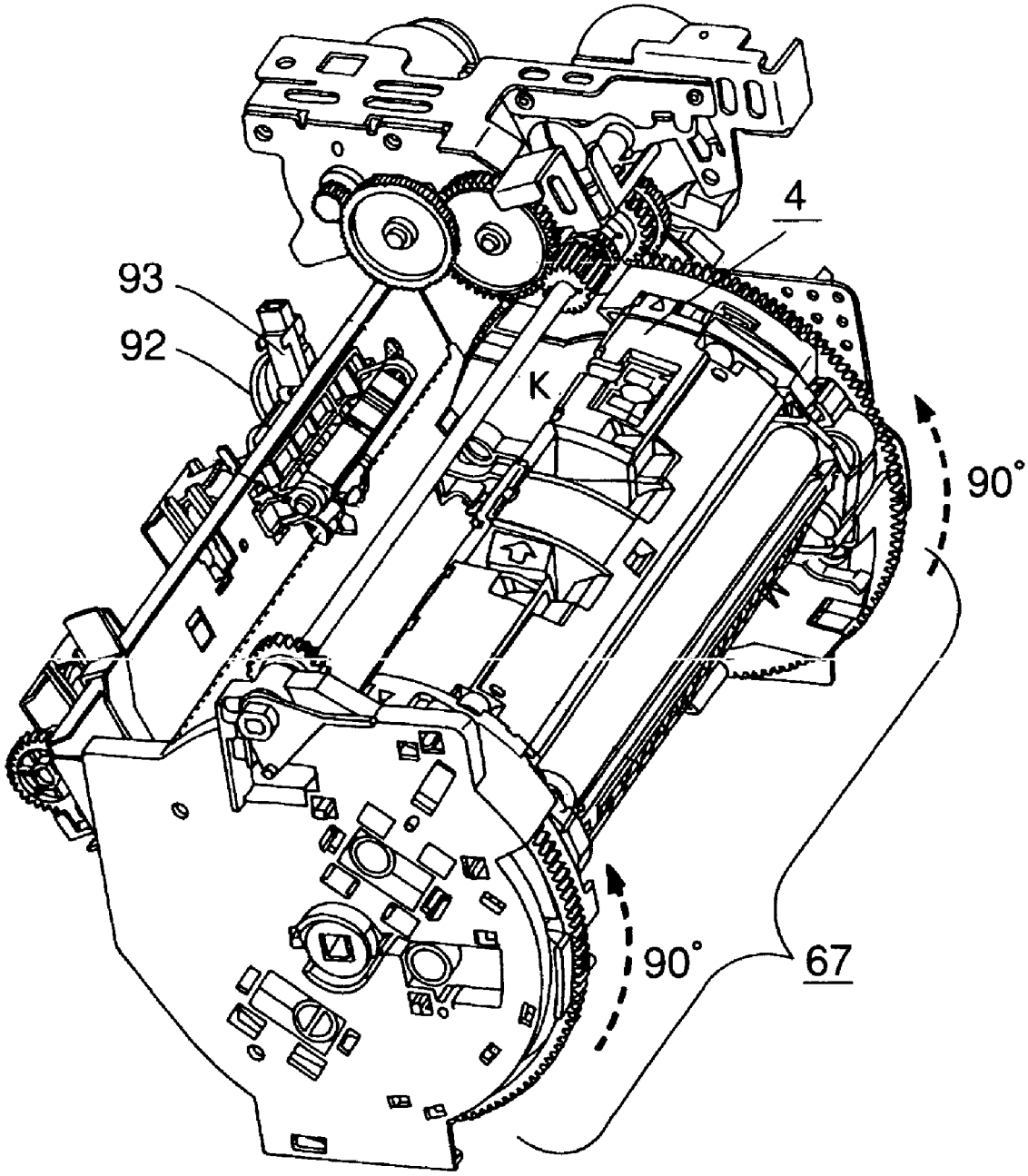
FIG. 14 is a perspective view of the rotary member, in which a development cartridge has been properly mounted.

The first projection 352L and retractable projection 380*b* are coaxial. Therefore, the development cartridge 4 is allowed to pivotally move about the axial line of the first projection 352L. However, the cartridge pressuring springs 53 for keeping the development cartridge 4 pressured in the direction to rotate the development cartridge 4 in the counterclockwise direction of the drawing are partially projecting into the cartridge guiding grooves 50*c*, one for one. Therefore, the second and third projections 353L and 353R of the development cartridge 4 are kept in contact with the second and third cartridge positioning portions 50*b*L and 50*b*R of the flanges 50L and 50R, respectively. As a result, the development cartridge 4 is accurately positioned, and kept accurately positioned, relative to the rotary member 67 (FIG. 14).

On the other hand, in order to remove the development cartridge 4 from the rotary member 67, first, the hinge-like handle 381 is to be grasped, as shown in FIG. 4, to retract the retractable projections 380*a* and 380*b* so that they allow the development cartridge 4 to be removed upward from the rotary member 67, by disengaging from the holes 50*d*.

As described above, the development cartridge 4 can be removed or mounted by the operation carried out by a user. Further, with the provision of the above described structural arrangement and method for solidly placing the development cartridge 4 in the rotary member 67, the development cartridge 4 does not become disengaged from the rotary member 67 while the rotary member 67 is rotated.

{Structure of Mechanism for Driving Development Cartridge}

Next, the structure of the mechanism for driving the development cartridge 4 will be described in detail.

Referring to FIG. 12, the rotary flanges 50L and 50R are provided with a side plate 54, which is on the outward side of each rotary flange. The center axle 51 of the rotary member 67 is disposed in a manner to penetrate the pair of flanges 50L and 50R, and the pair of side plates 54. More specifically, the rotary flanges 50L and 50R and the center axle 51 are rotationally supported by the side plates 54 so that the development cartridges 4 can be orbitally moved.

To one of the side plate 54, a gear train, that is, a set of gears meshed in a predetermined order, is attached. The driving force input gear 307 of the development cartridge 4, shown in FIG. 16, meshes with the final gear, that is, the most downstream gear of the above described gear train on the side plate 54, and rotationally drives the development roller 305, coating roller, stirring members, etc.

In this embodiment, as the flanges 50L and 50R are rotated a predetermined angle, each development cartridge 4 is orbitally moved the same angle. Further, as the development cartridge 4 is orbitally moved, the input gear 307 of the development cartridge 4 is engaged with the final gear 55 on one of the side plates 54 of the rotary member 67.

{Development Cartridge Engagement by Rotary Rotation, and Driving of Development Cartridge}

It is possible that when the development cartridge 4 is orbitally moved into the development position by the rotation of the rotary member 67, the teeth of the driving force input gear 307 of the development cartridge 4 collide with the teeth of the final gear 55 of the side plate 54 of the rotary member 67, and fail to properly mesh. In this embodiment, however, the development cartridge 4 is allowed to temporarily pivot backward about the fourth cartridge positioning portion 50*a*R of the flange 50R. Therefore, it is assured that the teeth of the driving force input gear 307 properly mesh with those of the final gear 55 on the side plate 54.

Figure 17:
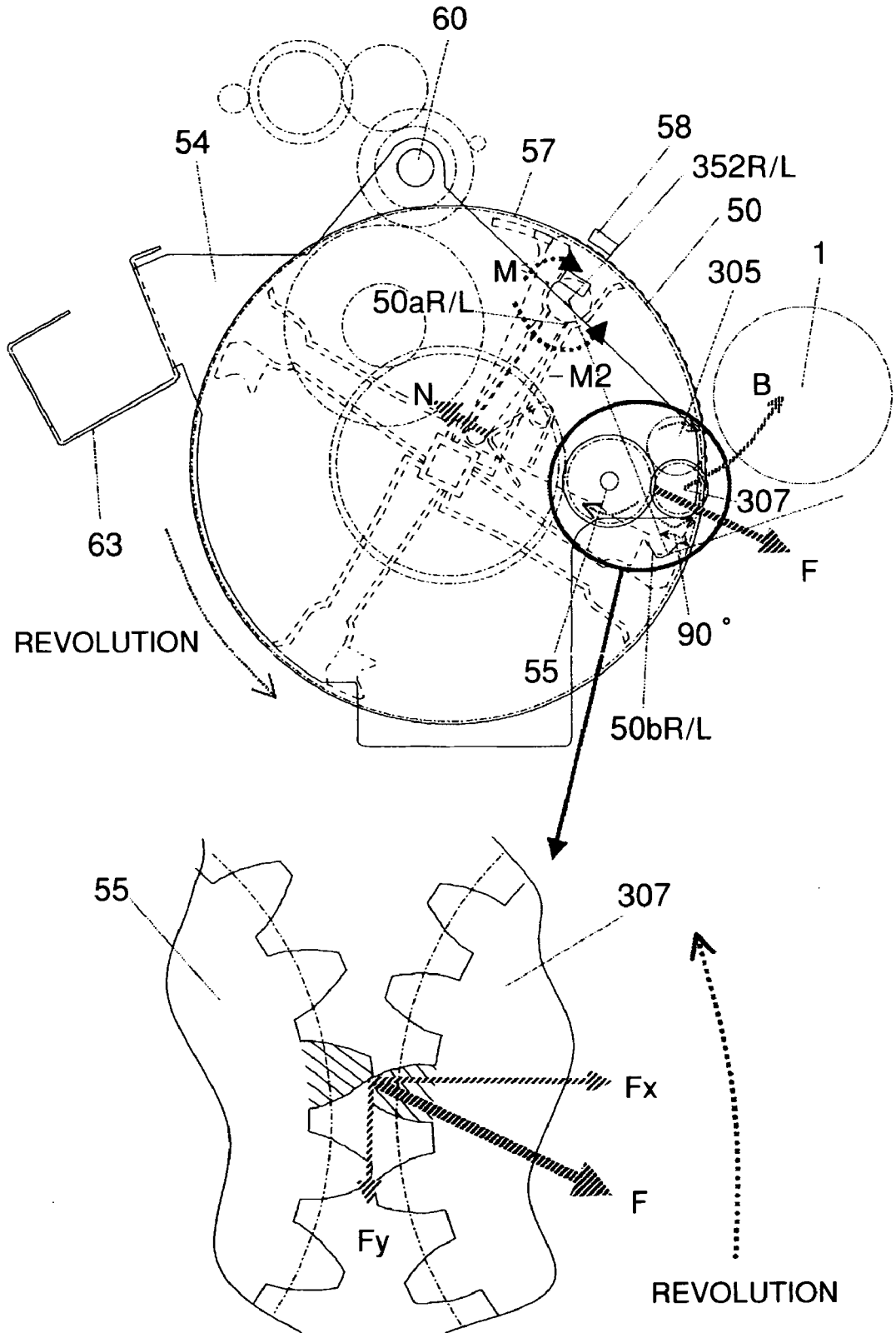
FIG. 17 is a phantom side view of the development cartridge and rotary unit, for showing how the tips of the teeth of the driving force input gear of the development collide with their counterparts, and how the development cartridge is driven, when and after the development cartridge is orbitally moved to the development position by the rotary unit.

To describe this process in more detail, referring to FIG. 17, when the input gear 307 of the development cartridge 4 is not in synchronism with the final gear 55 of the rotary member 67 in terms of tooth position, the teeth of the former collide with those of the latter. As a result, the input gear 307 is subjected to the reactive force F from the collision, which acts in the direction shown in FIG. 17.

The vectors resulting from the reactive force F generate such a moment M that acts in the direction to pivotally move the development cartridge 4 about the first and fourth projections 352L and 352R in the counterclockwise direction. This moment M2 is greater than the moment M generated by the pressure N from the cartridge pressuring springs 53. Therefore, the development cartridge 4 is pressured in the direction indicated by an arrow mark B. In addition, the development cartridge 4 is pressured rightward of the drawing, by a force Fx, which is the x component of the reactive force F.

In this embodiment, however, the cartridge contacting portion 50*b*R-2 of the third cartridge positioning portions 50*b*R of the rotary member 67, that is, the outward cartridge contacting portion of the rotary member 67 in terms of the radius direction of the rotary member 67, is roughly perpendicular to the line connecting the center of the fourth projections 352R, as the referential portion relative to which the development cartridge 4 is positioned, about which the development cartridge 4 is pivotally movable, and the center of the third projection 353R.

Figure 18:
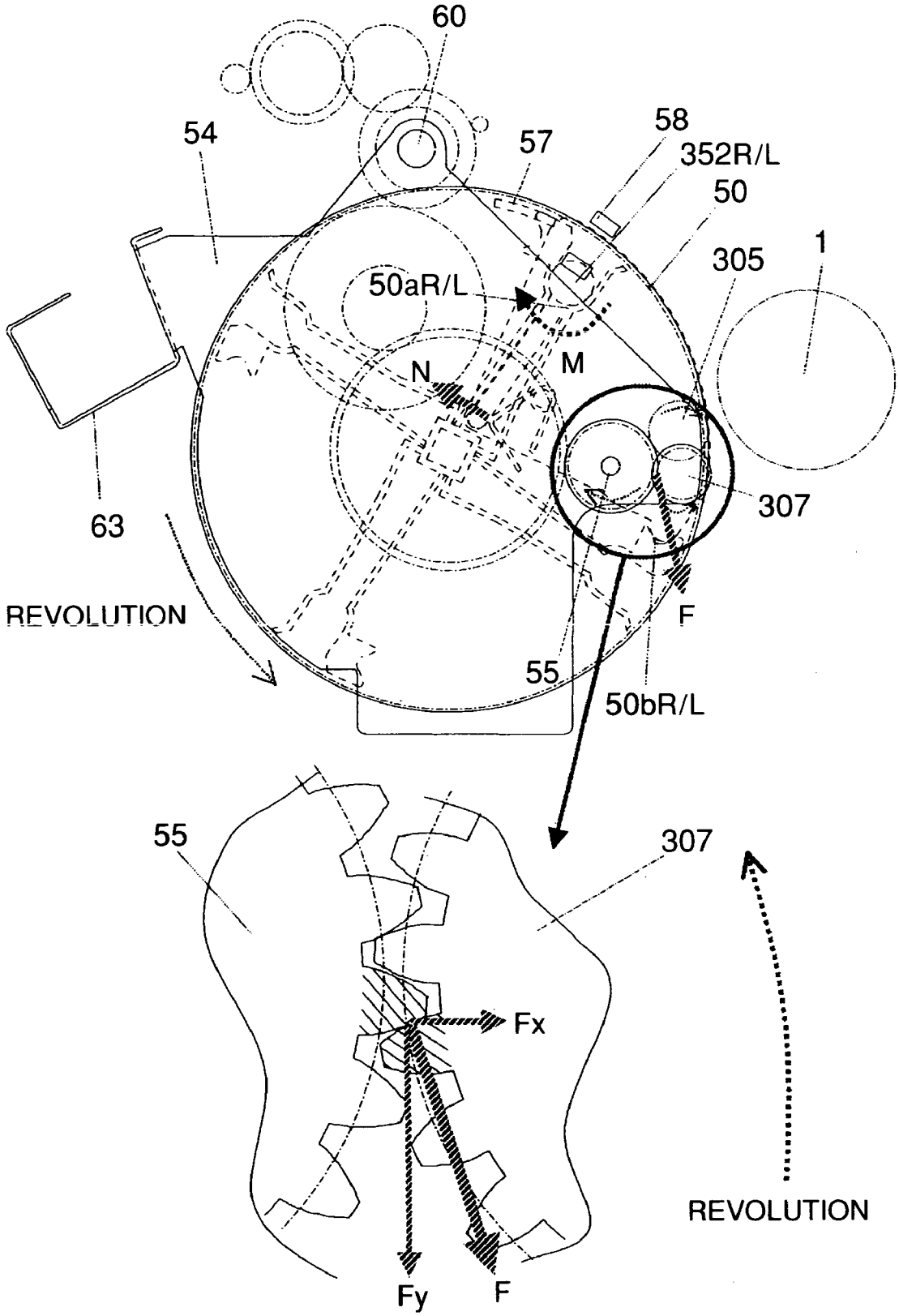
FIG. 18 is a phantom side view of the development cartridge and rotary unit, for showing how the driving force input gear of the development properly meshes with its counterpart, and how the development cartridge is normally driven, when and after the development cartridge is orbitally moved to the development position by the rotary unit.

Therefore, the development cartridge 4 is allowed to pivotally move in the direction indicated by the arrow mark B; in other words, it is allowed to escape outward. As a result, the condition in which the aforementioned collision between the teeth of the input gear 307 of the development cartridge 4 and the final gear 55 of the rotary member 67 occurred does not exist, allowing the two sets of teeth to mesh as shown in FIG. 18.

Then, the development cartridge 4 is accurately positioned relative to the flanges 50L and 50R, in the predetermined manner, by the above described cartridge pressuring springs 53 of the flanges 50L and 50R, respectively.

As for the non-driven side of the development cartridge 4, the development cartridge 4 is allowed to pivotally move in the direction indicated by the arrow mark B about the first projection 352L as the referential portion for development cartridge positioning, about which the development cartridge 4 is pivotally movable. In other words, the non-driven side of the development cartridge 4 moves in the same manner as the driven side of the development cartridge 4 moves, which is needless to say.

After the completion of the driving of a given development cartridge, the development cartridge is orbitally moved out of the development position by the rotation of the rotary member 67. However, the final gear 55 of the flange 50R sometimes fails to instantly disengage from the input gear 307 of the development cartridge, when the development cartridge is moved out of the development position. Such a problem is also solved by the above-described mechanism for allowing the development cartridge 4 to pivotally move; it is assured by the above described mechanism that the final gear 55 of the rotary member 67 smoothly disengages from the input gear 307 of the development cartridge 4, allowing thereby the development cartridge 4 to be orbitally moved out of the development position.

The first and fourth projections 352L and 352R of the development cartridge 4 in this embodiment, about which the development cartridge 4 is pivotally movable, are located in the adjacencies of the downstream end of the development cartridge 4 in terms of the direction in which the development cartridge 4 is orbitally moved. However, as the input gear 307 of the development cartridge 4 collides with the final gear 55 of the rotary member 67, the development cartridge 4 is pressured downward by the reactive force F resulting from the collision (FIG. 18).

Thus, upon the collision, the first and fourth projections 352L and 352R of the development cartridge 4 are going to move downward. However, they are caught and supported by the first and fourth cartridge positioning portions 50*a*L and 50*a*R of the flange 50L and 50R, respectively. With the provision of the above described supporting structure, even if the development cartridge 4 is orbitally moved at a high speed, it does not occur that the development cartridge 4 dislodge from the flange 50L and 50R due to the collision which occurs in the driving force inputting portion.

{Pressure Applied to Development Cartridge during Development Cartridge Engagement, and Driving of Development Cartridge}

Referring to FIG. 16, as the input gear 307 of the development cartridge 4 is driven by the final gear 55 on the side plate 54 of the rotary member 67, it is subjected to the force F resulting from the driving. In addition, the pressure N from the cartridge pressuring springs 53 acts on the guiding rib 354, and therefore, a contact pressure W2 acts on the development roller 305. The combination of these three forces generate, in the development cartridge 4, such a moment M that acts in a direction to pivotally move the development cartridge 4 about the first cartridge positioning portion 50*a*L of the flange 50L in the counterclockwise direction of the drawing.

The development roller 305 rotates at a peripheral velocity roughly 150% greater than that of the photoconductive drum 1. In other words, the development roller 305 rotates roughly 1.5 times faster than the photoconductive drum 1.

With the presence of this difference in peripheral velocity between the development roller 305 and photoconductive drum 1, the development roller 305 is subjected to a force P which acts in the tangential direction. Therefore, the development cartridge 4 is subjected to such a moment M2 that acts to pivotally move the development cartridge 4 about the first cartridge positioning portion 50*a*L of the flange 50L of the rotary member 67, the counterclockwise direction of the drawing.

The clockwise moment M is substantially greater than the counterclockwise moment M2. Therefore, the second projection 353L of the development cartridge 4, that is, the projection on the non-driven side, is pressed on the second cartridge positioning portion 50*b*L of the flange 50L. Therefore, the development cartridge 4 is prevented from moving relative to the cartridge positioning point of the flange 50L, during the driving of the development cartridge 4.

Further, on the driven side of the development cartridge 4, the force F resulting from the driving of the gear 307 of the development cartridge 4 by the final gear 55 on the apparatus main assembly side acts on the driving force input shaft 308. Thus, the third projection 353R (353R-1 and 353R-2) of the driven end of the development cartridge 4 is prevented by this force F from moving from the two contact portions, that is, the portions 50*b*R-1 and 50*b*R-2 of the third cartridge positioning portion 50*b*R.

In this embodiment, the third projection 353R of the development cartridge 4 is located on the downstream side of the force F which results from the driving of the driving force input gear 307 of the development cartridge 4 by the final gear 55 on the side plate 54 of the rotary member 67 and acts on the driving force input shaft. Therefore, it is assured that the third projection 353R is firmly held by the third cartridge positioning portion 50*b*R of the flange 50R.

As described above, the development cartridge 4 is accurately positioned in the rotary member 67, and firmly held therein. Therefore, the vibrations which are likely to occur due to the meshing of gears, in the driving force inputting portion, do not occur.

Incidentally, during a development operation, at the driven end of the development cartridge 4, the third projection 353R (353R-1 and 353R-2) functions as a positional reference, and the fourth projection 352R functions as a rotation controlling portion. Further, after the accurate positioning of the development cartridge 4 in the rotary member 67, there remains a small amount of play S (FIG. 8) between the fourth projection 352R of the development cartridge 4 and the fourth cartridge positioning portion 50*a*R of the flange 50R, allowing thereby the fourth projection 352R, as the portion about which the development cartridge 4 is allow to pivotally move, to move slightly.

Therefore, the effects of the errors in component dimension can be absorbed by this play S, making it possible to prevent the development cartridge 4 from being mounted improperly in terms of its positional relationship relative to the rotary member 67.

Also in this embodiment, the force for driving the development cartridge 4 begins to be transmitted to the development cartridge 4 before the development roller 305 comes into contact with the photoconductive drum 1. Therefore, the pre-rotation time for the development roller 305 can be secured without the need for lengthening the cartridge switching time.

The force F generated by the driving of the driving force input gear 307 by the final gear 55 on the side plate 54 of the rotary member 67 is a part of the closed dynamic system confined within the rotary member 67. Therefore, the force F has little effect upon the pressure applied to the photoconductive drum 1 by the development cartridge 4, which will be described later.

Referring to FIG. 18, as the development cartridge 4 is moved from a position in which the driving force input gear 307 of the development cartridge 4 is not engaged with its counterpart on the rotary side, and therefore, the development cartridge 4 is not driven, to the position in which the driving force input gear 307 is engaged with its counterpart on the rotary member side, and therefore, the development cartridge 4 is driven, the development cartridge 4 and the input gear 307 therein are subjected to the reactive force, which results from the engagement and driving of the development cartridge 4, and which acts in the normal rotational direction of the input gear 307. Incidentally, the rotational direction of the driving force input gear 307 of the development cartridge 4 in this embodiment is the same as the direction (counterclockwise direction) in which the development cartridge 4 is orbitally moved.

Therefore, as the development cartridge 4 is orbitally moved from the aforementioned pre-engagement position to the engagement position, in other words, as the input gear 307 comes into contact with the final gear 55 of the rotary member 67, the development cartridge 4 and the input gear 307 therein are subjected to the reactive force F which acts in the normal rotational direction of the input gear 307 shown in the drawing.

Since the reactive force F, to which the development cartridge 4 and its input gear 307 are subjected upon the engagement between the input gear 307 and final gear 55, acts in the normal rotational direction of the input gear 307, the development roller 305 is not rotated in reverse by the reactive force F. Therefore, it does not occur that the toner in the development cartridge 4 is conveyed backward by the reversal rotation of the development roller 305. Therefore, it does not occur that the sealing member 356 or the like, shown in FIG. 2, is turned inside out by the reversal conveyance of the toner. Therefore, it does not occur upon the engagement between the input gear 307 and final gear 55 that the toner blows out of the development cartridge 4 due to the problem that the sealing member 356 or the like is turned inside out by the reversal conveyance of the toner, which is caused by the engagement.

{Structure of Mechanism for Applying Pressure on Development Cartridge}

In this embodiment, four development cartridges 4 different in the color of the toner contained therein are placed in the rotary member 67, and each development cartridge 4 is kept pressed on the photoconductive drum 1 in the following manner.

Referring to FIGS. 12 and 16, the flanges 50L and 50R are rotatably supported by the side plates 54 of the rotary member 67. More specifically, the side plates 54 are solidly attached to the shaft 60, which is rotatably supported by the side walls of the apparatus main assembly. In other words, the side plates 54 of the rotary member 67 are accurately positioned relative to the apparatus main assembly by the shaft 60. Therefore, the development cartridges 4, flanges 50L and 50R, and side plates 54 of the rotary member pivotally move together.

Thus, the development cartridge 4 is pressed upon, or moved away from, the photoconductive drum 1, by the pivotal movement of the combination of the development cartridges 4 and rotary 67.

This structure of making the development cartridge 4 and rotary member 67 pivot in combination makes it possible to dispose the development cartridge pressing mechanism outside the rotary member, instead of inside. Therefore it is possible to reduce the rotary member 67 in size, and in addition, it is possible to simplify the mechanism for pressing the development cartridge.

The rotary member 67 is pivotally moved by rotating the rotary pivoting cam 94, the axial line of which coincides with that of the rotational pressure application shaft 90. The rotary member 67 can be set to two positions, that is, the position in which the development roller 305 is kept in contact with the photoconductive drum 1 (FIG. 19) and the position in which it does not place the development roller 305 in contact with the photoconductive drum 1 (FIG. 21), by switching the rotational direction of the motor (unshown) for driving the cam 94.

Figure 15:
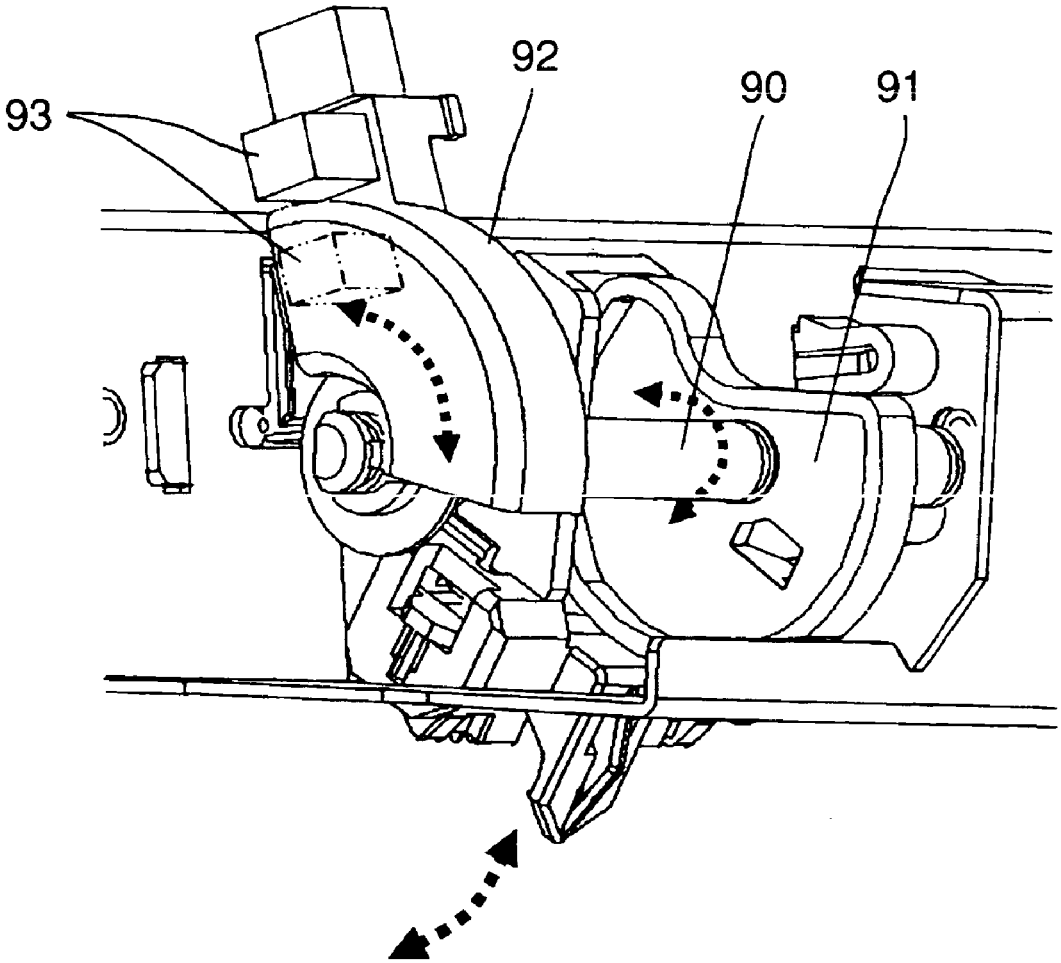
FIG. 15 is a perspective view of the control portion for controlling the pivotal movement of the rotary member.

Referring to FIG. 15, the rotary pivoting cam 94 is attached to the shaft 90, and a flag 92 is attached to one end of the shaft 90. The direction in which the rotary pivoting cam 94 is rotating is 92 blocks the sensor 93 (FIG. 14).

Figure 19:
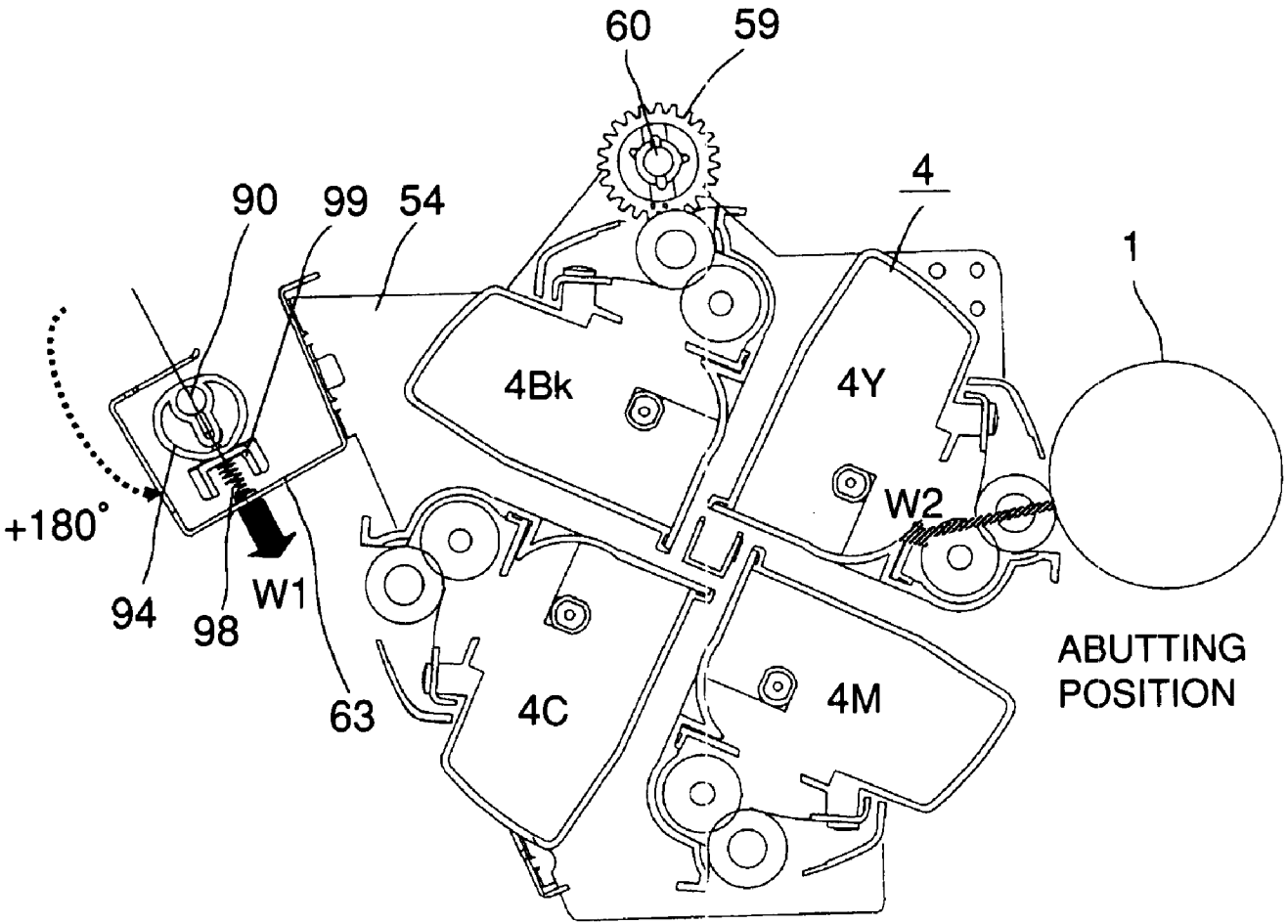
FIG. 19 is a sectional view of the rotary member, and the development roller of one of the development cartridges in which it is in contact with the photoconductive drum.

The development roller 305 of the development cartridge 4 is placed in contact with the photoconductive drum 1, by rotating forward the unshown cam driving motor for a predetermined length of time. With this forward rotation of the motor, the rotary pivoting cam 94 is rotated a predetermined angle, pressing thereby the tappet 99 downward (FIG. 19).

As a result, the side plate 54 of the rotary member 67 is rotated about the shaft 60 by the downward movement of the tappet 99, with the presence of a rotary pressing spring 98 between the tappet 99 and the side plate 54. Therefore, the rotary member 67 is pushed (pivoted) toward the photoconductive drum 1.

In order to move the rotary member 67 away from the photoconductive drum 1, the operation carried out to move the rotary member 67 toward the photoconductive drum 1 is to be carried out in reverse; the unshown cam driving motor is to be rotated backward.

Incidentally, in this embodiment, the rotary member 67 can be set to two positions, that is, the half and full distance positions, in which the development roller 305 of the development cartridge 4 does not contact the photoconductive drum 1. More specifically, when the rotary member 67 is in the half distance position, the distance between the development roller 305 and photoconductive drum 1 is roughly 2 mm (L/2=2 mm), whereas when the rotary member 67 is in the full distance position, the distance between the development roller 305 and photoconductive drum 1 is roughly 4 mm (L=4 mm).

Figure 20:
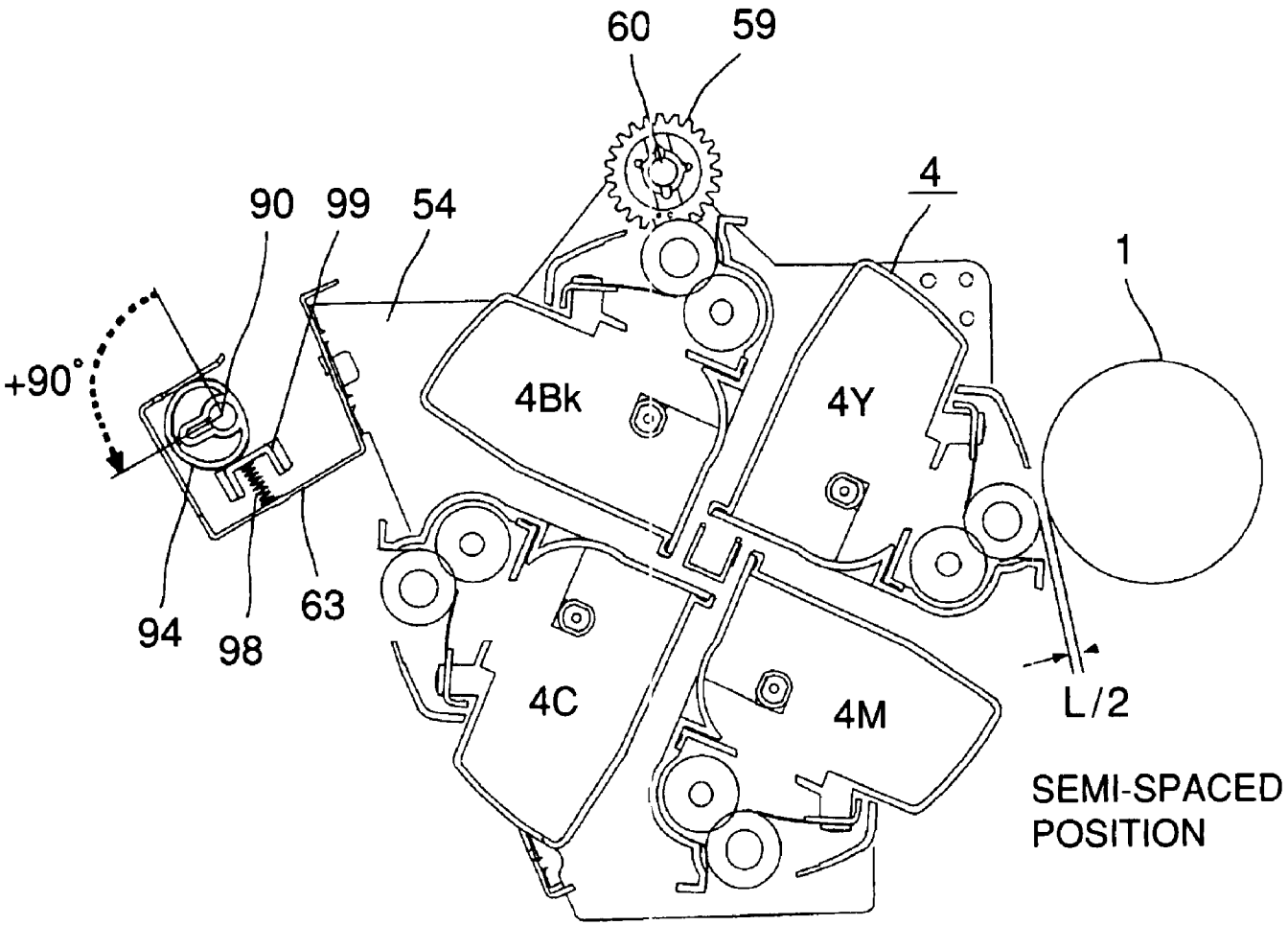
FIG. 20 is a sectional view of the rotary unit in the half distance position.
Figure 21:
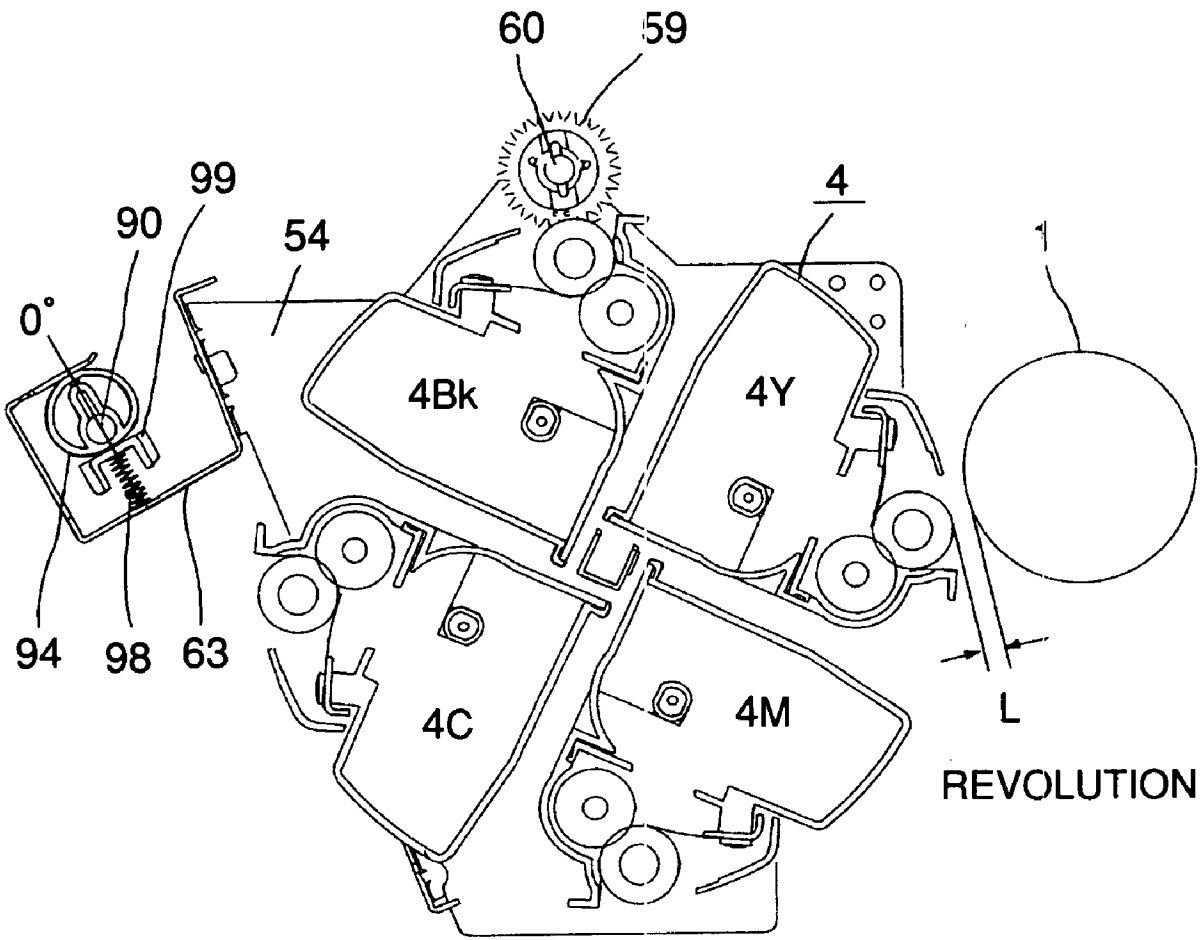
FIG. 21 is a sectional view of the rotary unit in the full distance position.

In other words, the rotary member 67 is allowed to take three different positions: the contact position shown in FIG. 19; the half distance position shown in FIG. 20, and the full distance position shown in FIG. 21. The rotary member 67 is placed in these three positions by rotating the unshown cam driving motor forward or backward so that the rotary pivoting cam 94 rotates 0°, 90°, or 180°.

Also in this embodiment, during an actual image forming operation, the rotary member 67 is pivotally moved only between the contact position, and the half distance position in which the rotary member 67 is rotated. The full distance position is used only to remove the development cartridge 4, or to read, or write into, the memory tag of the development cartridge 4.

When the rotary member 67 is pivotally moved toward the photoconductive drum 1 from the half distance position to place the development roller 305 of the development cartridge 4 in contact with the photoconductive drum 1, the distance the rotary member 67 travels is substantially shorter (half) than that when the rotary member 67 is pivotally moved toward the photoconductive drum 1 from the full distance position to place the development roller 305 of the development cartridge 4 in contact with the photoconductive drum 1. Therefore, the amount of the shock and operational noises to which the photoconductive drum is subjected when the rotary member 67 is moved from the half distance position is half the amount of shock and operational noises to which the photoconductive drum is subjected when the rotary member 67 is moved from the full distance position.

As described previously, the development cartridge 4 is positioned relative to the rotary member 67 at a total of four portions, that is, two portions at the left end and two portion at the right end.

Referring to FIG. 3, designated by a referential letter h is the line connecting the axial lines of the first and fourth projections 352L and 352R as the positioning portions, and designated by a referential letter p is the line connecting the axial lines of the second and third projections 353L and 353R. Further, designated by a referential letter v is the generator (which is parallel to axial line) of the development roller 305. In this embodiment, the development cartridge 4 is structured so that the lines h and p become parallel to the generator v.

Further, the development roller 305 is disposed so that its axial line is placed between the lines h and p. Therefore, the contact pressure W which occurs between the development roller 305 and photoconductive drum 1 can be evenly borne by the four projections, preventing thereby the development cartridge 4 from being twisted. Therefore, it does not occur that one side of the development roller 305 is pressed harder on the photoconductive drum 1 than the other side.

{Control of Rotary Rotation}

Referring to FIG. 12, the peripheral portions of the flanges 501 and 50R are in the form of a gear, and the rotary member 67 is provided with a pair of follower gears 59, which are disposed at the lengthwise ends, one for one, and are engaged with the gear portions of the flanges 50L and 50R, one for one. The pair of follower gears 59 is connected by the rotational axle. Thus, when one of the rotary flanges, for example the flange 50R, rotates, the other flange, that is, the flange 50L, is rotated in the same phase through the pair of follower gears 59.

With the provision of this driving structure, it is prevented that one of the flanges 50L and 50R is twisted while the flanges 50L and 50R are rotated to orbitally move the development cartridge 4, or while the development cartridge 4 is driven.

The shaft 60 about which the side plates 54 are pivotally moved is provided with a rotary driving gear 59, which rotates the flanges 50R. This rotary driving gear 59 is connected to the rotary driving motor 61.

To the end of the rotational axle of the rotary driving motor 61, an encoder 62 of a known type is attached. The amount of the rotation of the rotary driving motor 61 is detected by this encoder 62 to control the revolution of the motor 61.

The flange 50L is provided with a flag 57, which perpendicularly projects inward from the peripheral portion of the flange 50L. This flag 57 passes a photo-interrupter 58 fixed to the side plate 54, as shown in FIG. 16, as the rotary 67 is rotated.

In this embodiment, the rotation of the rotary member 67 for orbitally moving the development cartridges 4 is controlled so that the rotary member 67 is rotated through a predetermined angle with reference to the moment the flag 57 blocks the photo-interrupter 58. The rotational angle of the rotary member 67 is detected from the revolution of the motor 61 detected by the aforementioned encoder 62. It has been a common practice to control the rotation of the rotary member 67 with the use of a pulse motor or the like. In this embodiment, however, a DC motor is employed to rotate the rotary member 67, more quietly driving the rotary member 67.

It is possible that the development cartridge 4 is displaced from the development position by the unexpected rotation of the rotary member 67 caused by the driving of the development cartridge 4. Therefore, the rotary member 67 must be locked in place in terms of rotation so that it does not rotate.

It is possible to electrically brake the DC motor as the rotary driving motor, in order to lock the rotary member 67 in terms of rotation. However, there is the possibility that braking the DC motor for a long time increases the temperature of the DC motor, which might result in the burnout of the coil in the motor.

Figure 23:
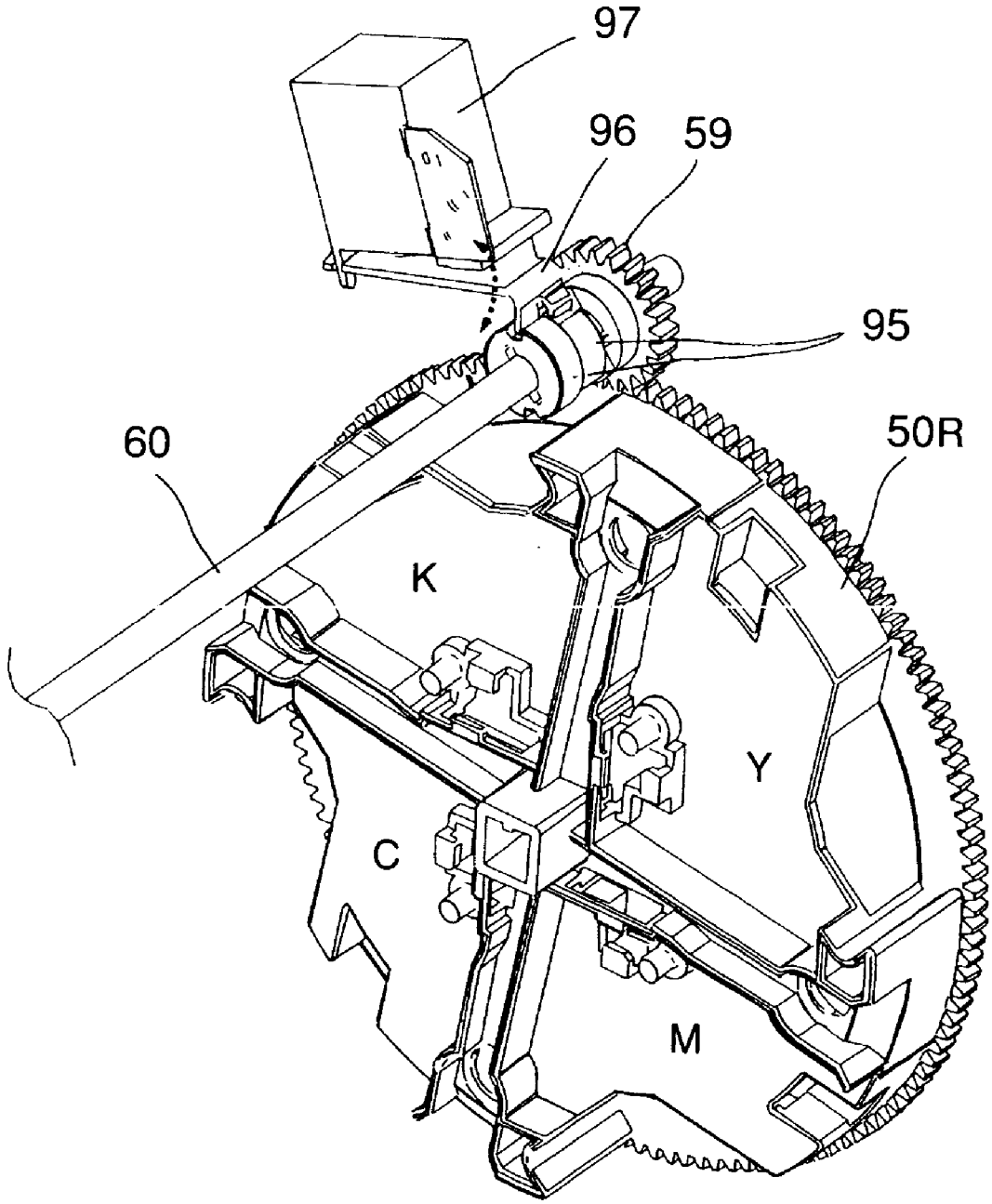
FIG. 23 is a perspective view of a part of the rotary unit, for showing the locking mechanism for keeping the rotary locked in place.

In this embodiment, therefore, the rotational axle of the follower gear 59 is provided with a locking groove 95, as shown in FIG. 23. Thus, each time the development cartridge 4 arrives at the predetermined position (development position), the claw of a stopper 96 is inserted into the locking groove 95.

The stopper 96 is moved up or down by turning on or off a solenoid 97 with a predetermined timing. In other words, in this embodiment, a mechanical locking mechanism is employed to prevent the rotary member 67 from unexpectedly rotating.

The above described above-described embodiment of the present invention has the effects which will be described next.

(1) It is assured that the development cartridge 4 is accurately positioned relative to the rotary member 67, and that the rotation of the rotary member 67 is stable. Therefore, it is possible to always print an excellent image.

(2) It is assured that the input gear 307 of the development cartridge 4 properly meshes with its counterpart, eliminating thereby the problem that the development roller 305 erratically rotates. Therefore, an excellent image can be formed.

(3) If the input gear 307 of the development cartridge 4 fails to properly mesh with the final gear 55 of the rotary member 67 immediately after the development cartridge 4 is orbitally moved to its designated position, the development cartridge 4 itself is allowed to temporarily and pivotally retract to assure that the input gear 307 properly meshes with the final gear 55. Therefore, the formation of an abnormal image, or printing errors, can be prevented.

(4) The development cartridge 4 is moved in combination with the rotary member 67, toward, or away from, the photoconductive drum 1, eliminating the need for a complicated mechanism for individually moving the development cartridge 4. Therefore, it is possible to reduce image formation apparatus cost.

(5) It is possible to begin driving the development cartridge 4 before the development roller 305 of the development cartridge 4 comes into contact with the photoconductive drum 1. Therefore, it is possible to increase image formation speed.

As is evident from the above description of the embodiment of the present invention, not only does the present invention make it possible to reduce image forming apparatus cost, but also the embodiment makes it possible to improve image forming apparatus in operability. Further, the embodiment makes it possible to increase image formation speed.

As described above, the effects of the present invention are as follows. That is, it is possible to increase the degree of accuracy with which a development cartridge and a process cartridge are attached to the main assembly of an electrophotographic image forming apparatus, and it is possible to reduce in size a development cartridge, a process cartridge, and an electrophotographic image forming apparatus in which such development cartridge and process cartridge are removably mountable. Further, it is possible to more easily and more reliably mount a development cartridge and a process cartridge into the main assembly of an electrophotographic image forming apparatus.

While the invention has been described with reference to the structures disclosed herein, it is not confined to the details set forth, and this application is intended to cover such modifications or changes as may come within the purposes of the improvements or the scope of the following claims.

What is claimed is:

1. A developing cartridge detachably mountable to a main assembly of an electrophotographic image forming apparatus, said apparatus comprising:

a frame;

a developing device configured and positioned to develop an electrostatic latent image formed on an electrophotographic photosensitive member;

a first projected portion, projected from said frame and configured and positioned to engage a first positioning portion provided in the main assembly of the apparatus when said developing cartridge is set in the main assembly of the apparatus to position said developing cartridge and around which said developing cartridge can rotate;

a second projected portion, projected from said frame and configured and positioned to engage a second positioning portion provided in the main assembly of the apparatus when said developing cartridge is set in the main assembly of the apparatus to regulate rotation of said developing cartridge about said first positioning portion; and a cartridge guide member, projected from said frame and configured and positioned to contact to a main assembly guide portion provided in the main assembly of the apparatus to guide said developing cartridge when said developing cartridge is in the process of being mounted to the main assembly of the apparatus, wherein said cartridge guide member is urged to urge said second projected portion in a direction to contact said second projected portion to said second positioning portion when said developing cartridge is set in the main assembly of the apparatus.

2. A developing cartridge according to claim 1, wherein said cartridge guide member has a portion to be urged which is urged by an urging member provided in the main assembly of the apparatus in a direction in which said second projected portion is urged to contact the second positioning portion.

3. A developing cartridge according to claim 1, wherein said cartridge guide member is disposed downstream of said first projected portion with respect to a mounting direction in which said developing cartridge is mounted to the main assembly of the apparatus.

4. A developing cartridge according to claim 3, wherein said cartridge guide member is in the form of a projection extending in the developing cartridge mounting direction.

5. A developing cartridge according to claim 4, wherein said first projected portion has a circular cross-section having a diameter which is larger than the width of said cartridge guide member.

6. A developing cartridge according to claim 1, wherein said second projected portion is disposed at a position spaced from said cartridge guide member with respect to a mounting direction in which said developing cartridge is mounted to the main assembly of the apparatus.

7. A developing cartridge according to claim 1 or 2, wherein said developing cartridge is detachably mountable on a rotary member which is rotatably supported in the main assembly of the apparatus and which is capable of being positioned in a developing position where said developing device is in a developing position at which said developing device is capable of developing an electrostatic latent image formed on the electrophotographic photosensitive member and a retracted position where said developing cartridge is retracted from the developing position.

8. A developing cartridge according to claim 7, wherein said developing cartridge includes a driving input gear configured and positioned to mesh with and engage a main assembly driving gear provided in the main assembly of the apparatus when said developing cartridge is moved to the developing position.

9. A developing cartridge according to claim 8, wherein said driving input gear is disposed at a position to receive a force from the main assembly driving gear in a direction in which said second projected portion is urged to contact the second positioning portion when a driving force is transmitted from the main assembly driving gear.

10. A developing cartridge according to claim 8, wherein said second projected portion is movable relative to the second positioning portion when said developing cartridge is moved from the retracted position to the developing position and the main assembly driving gear and said driving input gear are engaged with each other.

11. A developing cartridge according to claim 1, wherein said developing cartridge is detachably mountable on a rotary member which is rotatable supported in the main assembly of the apparatus, wherein said developing cartridge includes a locking member provided for movement in a longitudinal direction thereof, and wherein said locking member is engageable with a hole provided in the main assembly of the apparatus and is effective to prevent said developing cartridge from disengaging from the main assembly of the apparatus when the rotary member rotates.

12. A developing cartridge according to claim 2, wherein said developing cartridge is detachably mountable on a rotary member which is rotatable supported in the main assembly of the apparatus and which is capable of being positioned in a developing position where said developing device is in a developing position at which said developing device is capable of developing an electrostatic latent image formed on the electrophotographic photosensitive member and a retracted position where said developing cartridge is retracted from the developing position, wherein the portion to be urged is urged by the urging member in a direction to rotate said developing cartridge about said first projected portion in a direction opposite to a direction of rotation of said rotary member.

13. A developing cartridge according to claim 1, wherein said first projected portion is projected from each of longitudinal end of said frame, and said second projected portion is projected from each longitudinal end of said frame.

14. An electrophotographic image forming apparatus for forming an image on a recording material, comprising:

(i) a main assembly guide portion;

(ii) a first positioning portion;

(iii) a second positioning portion;

(iv) a mounting portion configured and positioned to detachably mount a developing cartridge which includes a frame, a developing device configured and positioned to develop an electrostatic latent image formed on an electrophotographic photosensitive member, a first projected portion, projected from the frame, configured and positioned to engage said first positioning portion provided in a main assembly of said apparatus when the developing cartridge is set in the main assembly of said apparatus to position the developing cartridge and around which the developing cartridge is rotatable, a second projected portion, projected from the frame, configured and positioned to engage said second positioning portion provided in the main assembly of said apparatus when the developing cartridge is set in the main assembly of said apparatus to regulate rotation of the developing cartridge about said first positioning portion, and a cartridge guide member, projected from the frame, configured and positioned to contact said main assembly guide portion provided in the main assembly of said apparatus to guide the developing cartridge when the developing cartridge is in the process of being mounted to the main assembly of said apparatus, wherein the cartridge guide member is urged to urge the second projected portion in a direction to contact the second projected portion to the second positioning portion when the developing cartridge is set in the main assembly of said apparatus; and (v) a feeding device configured and positioned to feed the recording material.

15. An apparatus according to claim 14, further comprising an urging member configured and positioned to urge a portion to be urged provided in the cartridge guide member in a direction in which the second projected portion is urged to contact said second positioning portion.

16. An apparatus according to claim 15, wherein the urging member is disposed downstream of said first positioning portion with respect to a mounting direction in which the developing cartridge is mounted to the main assembly of said apparatus.

17. An apparatus according to claim 14, further comprising a rotary member which is rotatably supported in the main assembly of said apparatus and which is capable of being positioned in a developing position where the developing device is in a position in which the developing device is capable of developing an electrostatic latent image formed on the electrophotographic photosensitive member and a retracted position where the developing cartridge is retracted from the developing position.

18. An apparatus according to claim 17, further comprising a main assembly driving gear configured and positioned to engage a driving input gear provided in the developing cartridge when the developing cartridge is moved to the developing position, said main assembly driving gear being provided at a position for urging the driving input gear in a direction in which the second projected portion is urged to contact said second positioning portion when a driving force is transmitted to the driving input gear.

19. An apparatus according to claim 18, wherein the second projected portion is movable relative to said second positioning portion when the developing cartridge is moved from the retracted position to the developing position and said main assembly driving gear and the driving input gear are engaged with each other.

* * * * *

UNITED STATES PATENT AND TRADEMARK OFFICE

CERTIFICATE OF CORRECTION

PATENT NO. : 6,983,115 B2
APPLICATION NO. : 10/668494
DATED : January 3, 2006
INVENTOR(S) : Hironobu Isobe et al.

It is certified that error appears in the above-identified patent and that said Letters Patent is hereby corrected as shown below:

COLUMN 1
Line 40, “member;” should read --member,--.

COLUMN 2
Line 23, “mountable.” should read
--mountable.
Another object of the present invention is to provide a development cartridge and a process cartridge, which can be reduced in size, and an electrophotographic image forming apparatus in which such development cartridge and process cartridge are removably mountable.--
Line 37, “photo” should read -- photo- --.
Line 39, “developments” should read --development--.

COLUMN 3
Line 18, “cartridge” (first occurrence) should be deleted.

COLUMN 4
Line 35, “rotary.” should read --rotary member.--.
Line 42, “rotary.” should read --rotary member.--.

COLUMN 5
Line 62, “image.” should read --image).--.

COLUMN 6
Line 64, “devices” should read --device--.

COLUMN 7
Line 6, “roller 51” should read --roller 5f--.

COLUMN 11
Line 61, “projection” should read --projections--.
Line 63, “rods,” should read --rod,--.

COLUMN 12
Line 4, “attached” should read --attached to--.

COLUMN 13
Line 34, “plate 54,” should read --plates 54,--.

UNITED STATES PATENT AND TRADEMARK OFFICE

CERTIFICATE OF CORRECTION

PATENT NO. : 6,983,115 B2
APPLICATION NO. : 10/668494
DATED : January 3, 2006
INVENTOR(S) : Hironobu Isobe et al.

It is certified that error appears in the above-identified patent and that said Letters Patent is hereby corrected as shown below:

COLUMN 15
Line 9, "dislodge" should read --dislodges--.

COLUMN 16
Line 14, "allow" should read --allowed--.

COLUMN 17
Line 29, "rotary 67." should read --rotary member 67.--.
Line 51, "rotating is" should read --rotating is detected by detecting the timing with which the flag--.

COLUMN 18
Line 47, "portion" should read --portions--.

COLUMN 19
Line 3, "501" should read --50L--.

COLUMN 20
Line 1, "above described" should be deleted.

COLUMN 22
Line 9, "rotatable" should read --rotatably--.
Line 21, "rotatable" should read --rotatably--.
Line 36, "of" should be deleted.

Signed and Sealed this

Twelfth Day of February, 2008

JON W. DUDAS
*Director of the United States Patent and Trademark Office*